US006591914B2

(12) United States Patent
Williamson, Jr.

(10) Patent No.: US 6,591,914 B2
(45) Date of Patent: Jul. 15, 2003

(54) HYDRAULIC CONTROL SYSTEM FOR DOWNHOLE TOOLS

(75) Inventor: Jimmie R. Williamson, Jr., Carrollton, TX (US)

(73) Assignee: Hallliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/943,038

(22) Filed: Aug. 30, 2001

(65) Prior Publication Data

US 2002/0053438 A1 May 9, 2002

(30) Foreign Application Priority Data

Oct. 3, 2000 (WO) ..... PCT/US00/27278

(51) Int. Cl.[7] ..... E21B 49/08
(52) U.S. Cl. ..... 166/369; 166/53; 166/72
(58) Field of Search ..... 166/53, 52, 66.7, 166/66, 250.15, 50, 65.1, 66.6, 313, 369

(56) References Cited

U.S. PATENT DOCUMENTS 5,868,201 A * 2/1999 Bussear et al. ..... 166/53
5,975,204 A * 11/1999 Tubel et al. ..... 166/250.15
6,109,357 A 8/2000 Zimmerman
6,182,764 B1 * 2/2001 Vaynshteyn ..... 166/250.01

FOREIGN PATENT DOCUMENTS

| | | | |
|---|---|---|---|
| GB | 2321076 A | * | 7/1998 |
| WO | WO 98/09055 A1 | | 3/1998 |
| WO | WO 98/39547 A2 | | 9/1998 |
| WO | WO 00/29715 A1 | | 5/2000 |

* cited by examiner

*Primary Examiner*—Frank Tsay
(74) *Attorney, Agent, or Firm*—Marlin R. Smith

(57) ABSTRACT

A hydraulic control system and associated methods provides selective control of operation of multiple well tool assemblies. In a described embodiment, a hydraulic control system includes multiple control modules, each of which has a member that is displaceable to multiple predetermined positions to thereby select a corresponding one of multiple well tool assemblies for operation thereof. When the member of a certain control module is in a selected position, an actuator of a corresponding one of the well tool assemblies is placed in fluid communication with a flowpath connected to the control module. The members of the multiple control modules are displaced simultaneously in response to pressure on a line connected to each of the control modules.

47 Claims, 27 Drawing Sheets

HYDRAULIC CONTROL SYSTEM FOR DOWNHOLE TOOLS

CROSS-REFERENCE TO RELATED APPLICATION

This application claims the benefit under 35 USC §119 of the filing date of PCT Application No. PCT/US00/27278, filed Oct. 3, 2000, the disclosure of which is incorporated herein by this reference.

BACKGROUND

The present invention relates generally to methods and apparatus utilized in conjunction with subterranean wells and, in an embodiment described herein, more particularly provides a hydraulic control system for downhole tools.

It would be desirable to be able to operate selected ones of multiple hydraulically actuated well tools installed in a well. However, it is uneconomical and practically unfeasible to run separate hydraulic control lines from the surface to each one of numerous well tool assemblies. Instead, the number of control lines extending relatively long distances should be minimized as much as possible.

Therefore, it would be highly advantageous to provide a hydraulic control system which reduces the number of control lines extending relatively long distances between multiple hydraulically actuated well tools and the surface. The hydraulic control system would preferably permit individual ones of the well tools to be selected for actuation as desired. The selection of well tools for actuation thereof should be convenient and reliable.

Furthermore, it would be desirable to provide methods of controlling operation of multiple well tools, and it would be desirable to provide well tools which maybe operated utilizing such a hydraulic control system.

SUMMARY

In carrying out the principles of the present invention, in accordance with an embodiment thereof, a hydraulic control system is provided which solves the above problem in the art. Methods of controlling operation of multiple downhole tools, and well tools which may be controlled using such methods, are also provided by the invention.

In one aspect of the invention, a hydraulic control system is provided which includes multiple control modules for controlling operation of multiple well tool assemblies. Each of the control modules is connected to a corresponding one of the well tool assemblies. One or more flowpaths extending to a remote location, such as the earth's surface, are connected to each of the control modules.

The flowpaths are used to transmit fluid pressure to the control modules. Pressure on the flowpaths is used to select from among the well tool assemblies for operation thereof, and to operate the selected well tool assemblies. In one embodiment, pressure is applied to two of the flowpaths to select a well tool assembly, and pressure is applied to a third flowpath and/or one of the other two flowpaths to operate the selected well tool assembly.

In another aspect of the invention, each of the control modules includes a member which is displaced in response to pressure on one or more of the flowpaths. All of the members are displaced when appropriate pressure is on the flowpaths. For example, in one embodiment, pressure is applied alternately and repeatedly to two of the flowpaths to displace all of the members simultaneously. The members are each uniquely configured, so that only one of the well tool assemblies is selected at a time.

In yet another aspect of the invention, pressure on one of the flowpaths may be used to synchronize the members. Pressure on the flowpath causes each of the members to cease displacing in response to pressure on other flowpaths, when the member reaches a certain predetermined position. In this manner, all of the members may be placed in the predetermined position in the corresponding control module, at which point all of the members are synchronized with each other.

In still another aspect of the invention, the control modules may be configured so that a minimum pressure on a flowpath is required to displace each of the members past a certain position. Each of the members displaces up to the certain position when a lower pressure is used, but ceases displacing in response to the lower pressure when the position is reached. Thus, all of the members may be placed in the position by displacing the members using the lower pressure.

In a further aspect of the invention, a flowpath in communication with a tubular string or an annulus downhole may be placed in fluid communication with one of the flowpaths extending to the remote location using one of the control modules. In this manner, pressure in the tubular string or annulus may be selectively monitored at the remote location.

In a still further aspect of the invention, well tool assemblies are provided which are operable using the control systems disclosed herein. One well tool assembly is a valve, which is openable and closable by application pressure on the flowpaths extending to the remote location. Another well tool assembly is a variable choke. The choke includes a ratchet mechanism permitting a flow area through the choke to be incrementally and repeatedly varied.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
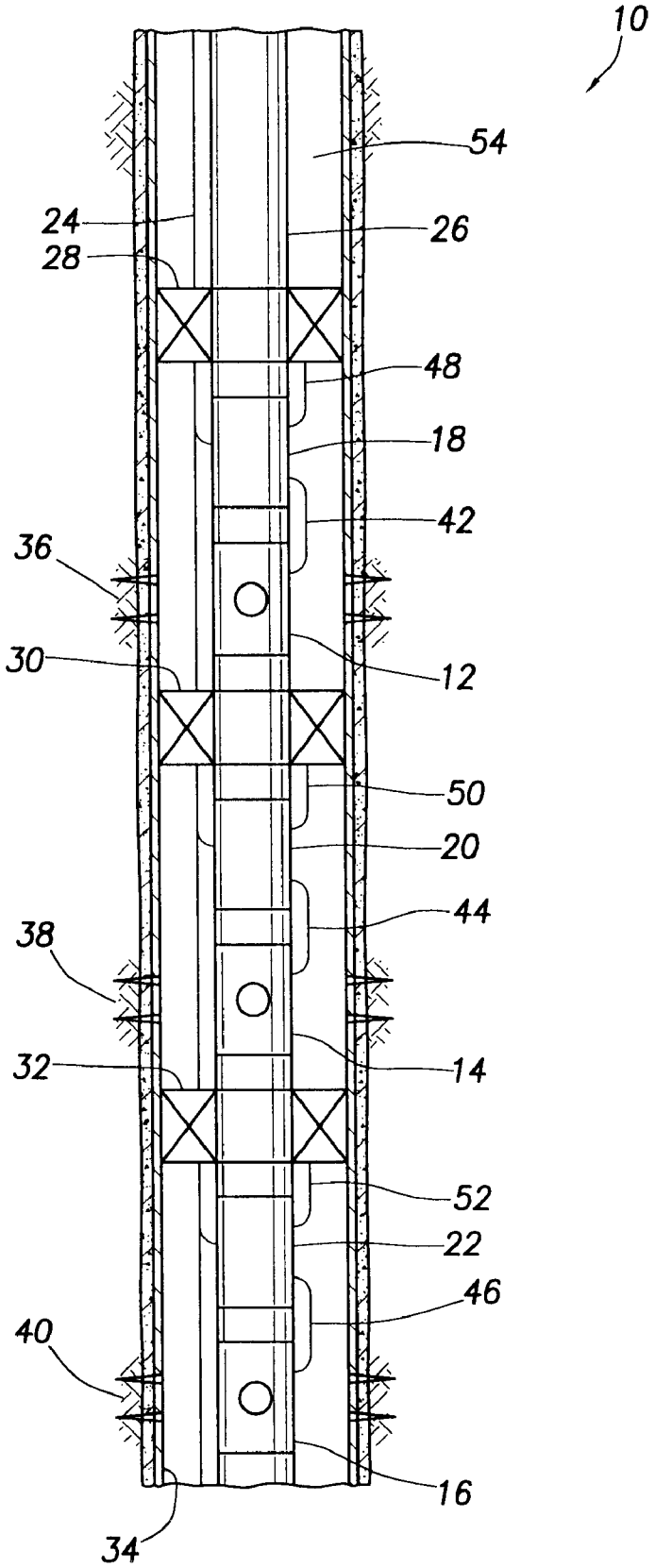
FIG. 1 is a schematic view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, operation of multiple well tool assemblies 12, 14, 16 is controlled by the use of multiple control modules 18, 20, 22. Each of the control modules 18, 20, 22 is connected to a corresponding one of the well tool assemblies 12, 14, 16 and is operable to control actuation of that corresponding well tool assembly. Specifically, the control modules 18, 20, 22 both select appropriate ones of the well tool assemblies 12, 14, 16 for actuation thereof, and route fluid pressure to the selected well tool assemblies to perform the actuation thereof. These selecting and routing functions of the control modules 18, 20, 22 are performed in response to pressure manipulations on multiple flowpaths or lines 24 interconnected to each of the control modules and extending to a remote location, such as the earth's surface.

It is to be clearly understood that the specific details of the method 10 described herein are not to be taken as limiting the principles of the present invention. For example, although only three well tool assemblies 12, 14, 16 and three control modules 18, 20, 22 are described, any number of well tool assemblies or control modules could be used. Each well tool assembly 12, 14, 16 and its corresponding control module 18, 20, 22 could be integrally, instead of separately, constructed. The lines 24, or portions thereof, could extend internal, rather than external, to a tubing string 26 in which the well tool assemblies 12, 14, 16 and control modules 18, 20, 22 are interconnected. Although the well tool assemblies 12, 14, 16 are depicted in FIG. 1 as being valves or other types of flow control devices, any other type of well tool assembly could be controlled by the control modules 18, 20, 22.

As an example of another type of well tool assembly which may be controlled by the control modules 18, 20, 22, hydraulically set packers 28, 30, 32 are shown interconnected in the tubing string 26 and sealingly engaged in a wellbore 34 of the well. The packers 28, 30, 32 isolate producing formations or zones 36, 38, 40 from each other in the wellbore 34. In one embodiment of the control modules 18, 20, 22 described below, the packers 28, 30, 32 are set simultaneously using the control modules and in response to pressure manipulations on the lines 24.

Fluid pressure is conducted between the control modules 18, 20, 22 and the well tool assemblies 12, 14, 16 via respective flowpaths or lines 42, 44, 46, and between the control modules and the packers 28, 30, 32 via respective flowpaths or lines 48, 50, 52. As with the lines 24 described above, these lines 42, 44, 46, 48, 50, 52 may be external or internal to the tubing string 26. In addition, as described below, more lines may extend from the control modules 18, 20, 22, for example, to an internal flow passage of the tubing string 26 or to an annulus 54 between the tubing string and wellbore 34 for monitoring pressure in the flow passage or annulus at the remote location via one or more of the lines 24.

Referring additionally now to FIGS. 2A–E, a control module 56 and well tool assembly 58 which embody principles of the present invention, and which may be used in the method 10, are representatively illustrated. Of course, the control module 56 and well tool assembly 58 may be used together or separately, and in other methods, without departing from the principles of the invention.

Figure 2A:
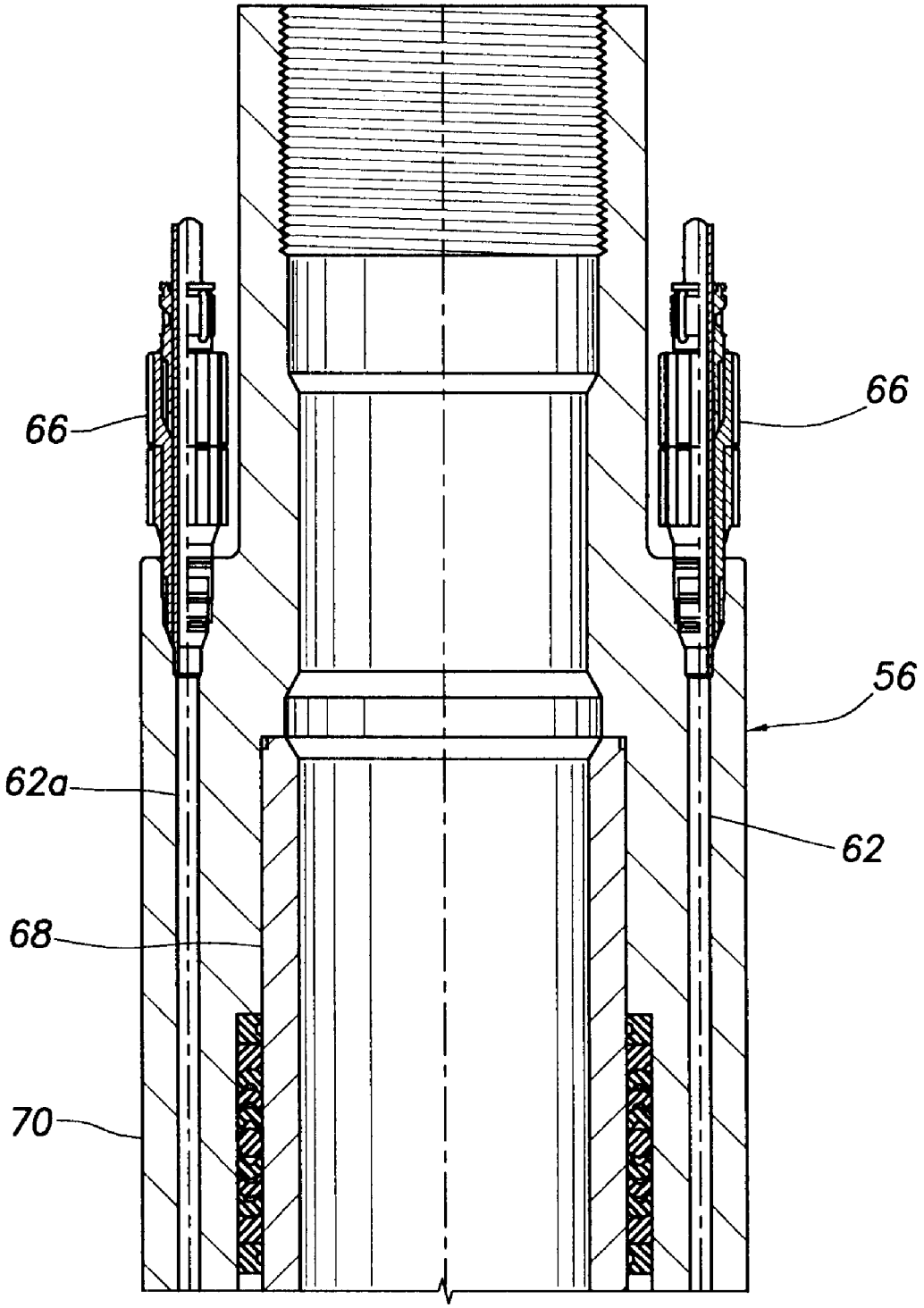
FIGS. 2A–E are cross-sectional views of successive axial sections of a first control module and well tool assembly usable in the method of FIG. 1.
Figure 2B:
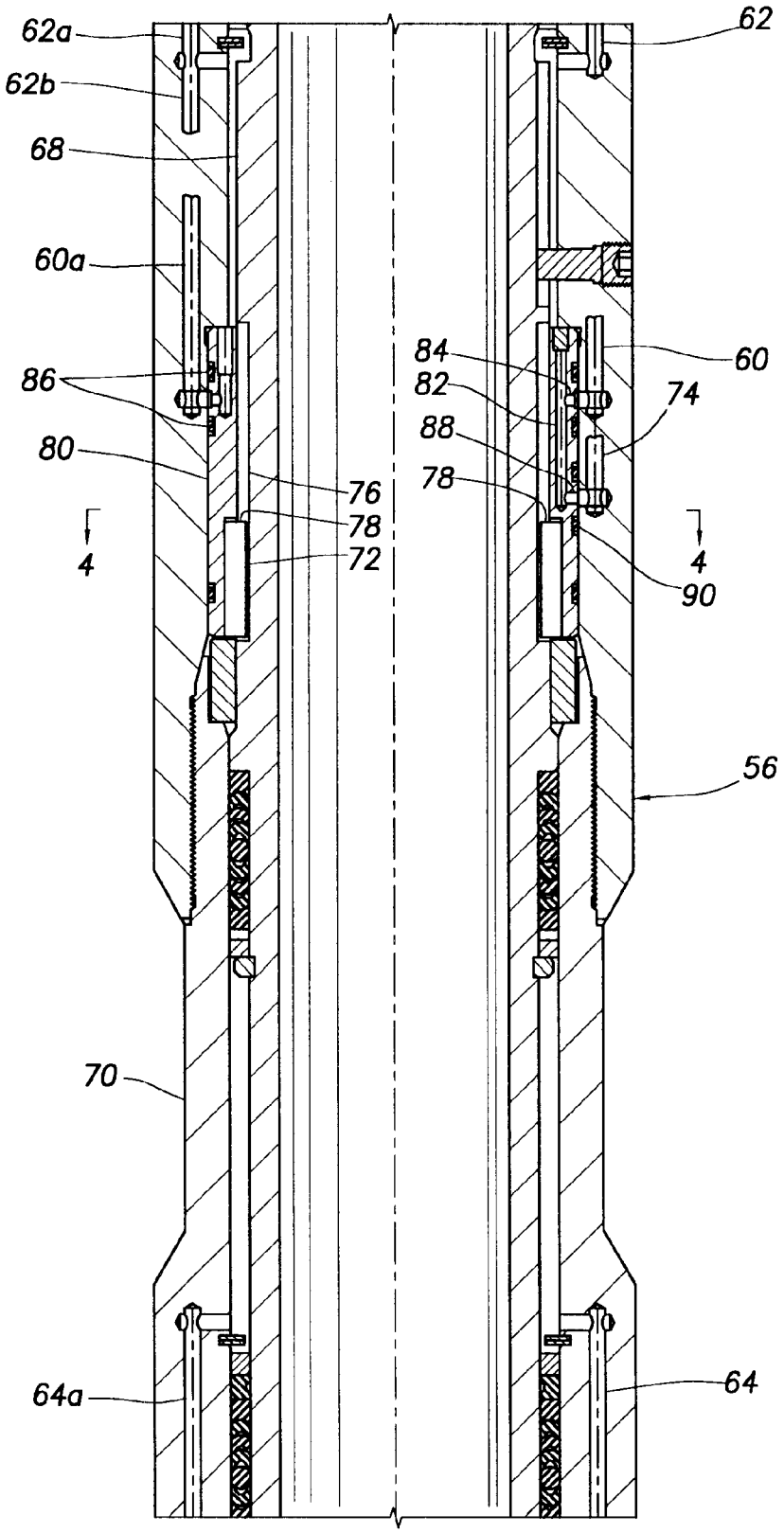
Figure 2C:
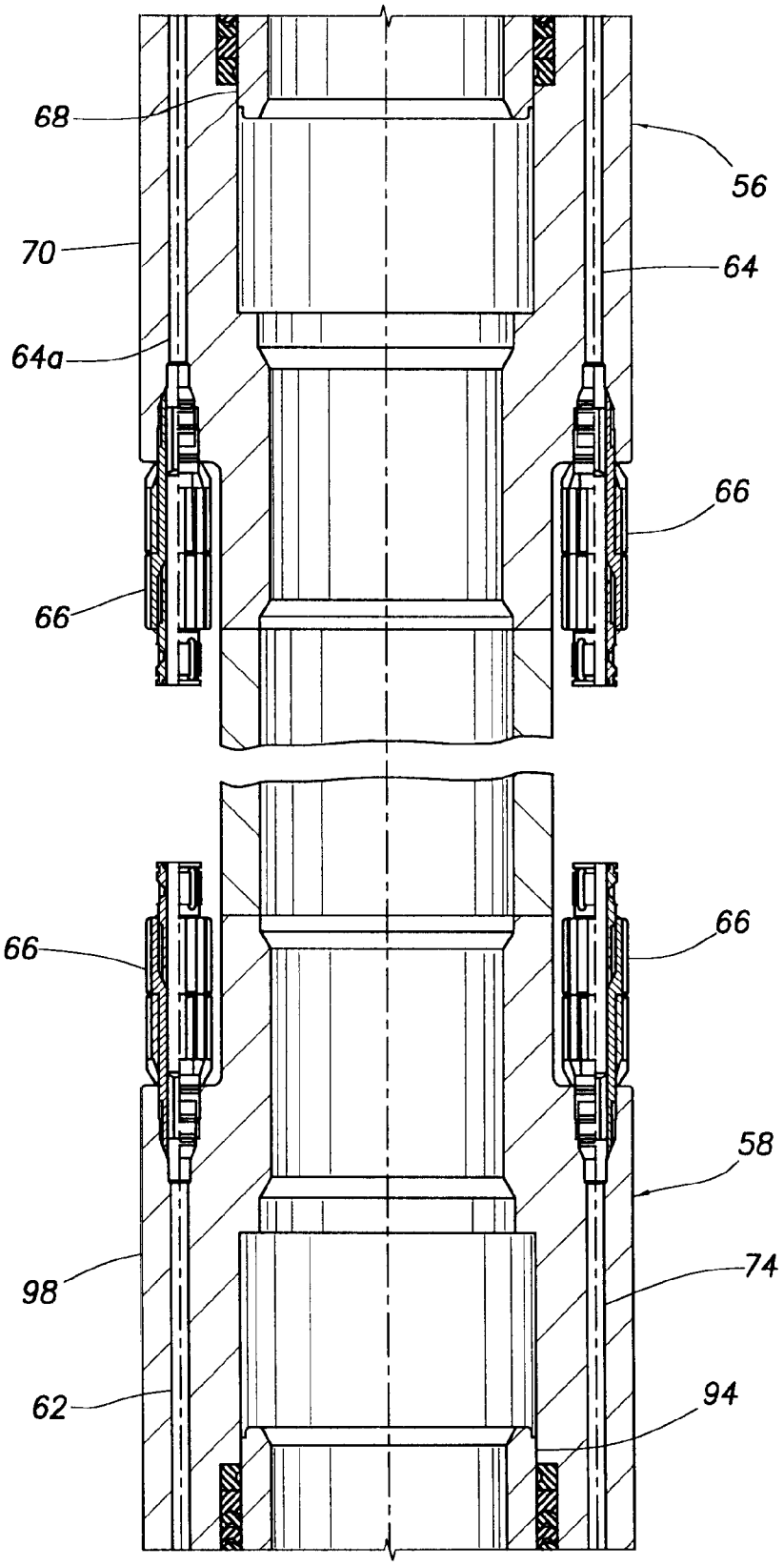

Three flowpaths or lines 60, 62, 64 are used in the control module 56 to control selection of the well tool assembly 58, and to provide fluid pressure for actuation of the well tool assembly. When used in the method 10, the flowpaths 60, 62, 64 would be connected to appropriate ones of the lines 24 using tubing fittings 66 or other connection means. The flowpath 60 is not shown extending to a fitting 66 on the exterior of the control module 56, since it is out of the plane of the illustrated cross-section, but preferably, the flowpath 60 does extend to such a fitting at an upper end of the control module, as shown for the flowpath 62. In FIGS. 2A–C, specific portions of the flowpaths 60, 62, 64 which extend to other control modules 56 (when additional control modules are used) are designated 60*a*, 62*a*, 64*a*. A portion of the flowpath 62 which extends from the control module 56 to the well tool assembly 58 for actuation thereof is designated 62*b* in FIG. 2B.

Pressure applied to the flowpath 62 biases an inner tubular mandrel 68 in a downward direction, and pressure applied to the flowpath 64 biases the mandrel in an upward direction, due to piston areas formed on the mandrel and its sealing engagement within an outer housing assembly 70 of the control module 56. By alternately applying pressure via the flowpaths 62, 64, the mandrel 68 is forced to displace upwardly and downwardly.

This reciprocating displacement of the mandrel 68 is used to operate a ratchet mechanism 72, which controls fluid communication between the flowpath 60 and another flowpath 74. The flowpath 74 extends to the well tool assembly 58 for actuation thereof. Thus, by reciprocating the mandrel 68, the ratchet mechanism 72 is operated and the flowpath 60 is selectively placed in fluid communication with the flowpath 74, used to actuate the well tool assembly 58.

The ratchet mechanism 72 includes a "J-slot" 76 formed as a continuous circumferentially extending recessed slot on the external surface of the mandrel 68, and two triangular-shaped lugs 78 engaged in the slot 76 and attached to a tubular selector member 80. As the mandrel 68 is reciprocated in the housing 70 by alternately applying pressure to the flowpaths 62, 64, the ratchet mechanism 72 causes the selector member 80 to rotate about the mandrel.

The flowpath 60 is continually in fluid communication with an internal longitudinal fluid passage 82 of the member

80 via a radially extending opening 84 positioned between seals 86 extending circumferentially about the member 80 and sealingly engaging the housing 70. Another radially extending opening 88 is formed in the selector member 80 and is in fluid communication with the flowpath 82.

A seal 90 encircles the opening 88 and sealingly engages the housing 70. This arrangement results in the flowpath 74 being in fluid communication with the passage 82 only when the opening 88 is radially aligned as depicted in FIG. 2B. Thus, as the selector member 80 is rotated by the ratchet mechanism 72, the flowpath 74 is usually not in fluid communication with the flowpath 60, but is placed in fluid communication with the flowpath 60 when the opening 88 is radially aligned as depicted in FIG. 2B.

Figure 3:
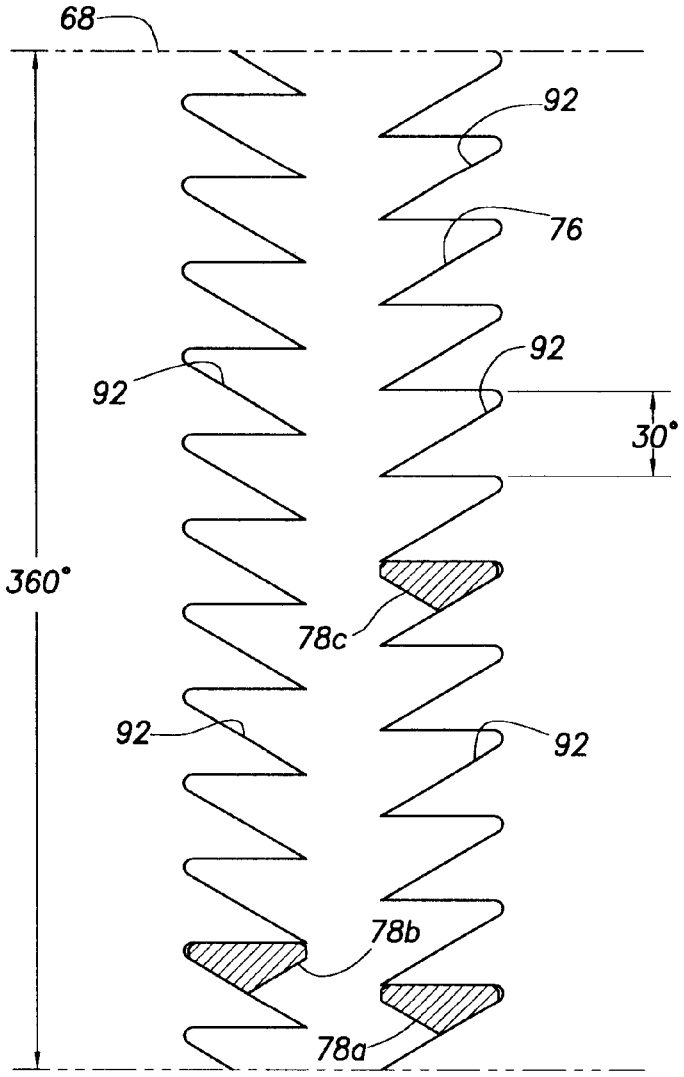
FIG. 3 is a plan "unrolled" view of a ratchet mechanism of the first control module.

Referring additionally now to FIG. 3, a plan view of the slot 76 on the mandrel 68 is representatively illustrated as if the mandrel were "unrolled". In this view, the full 360° extent of the slot 76 may be seen. The slot 76 is of the type known to those skilled in the art as a triangular J-slot, but other types of slots, other ratchet mechanisms or other incremental displacement devices may be utilized, without departing from the principles of the invention.

As indicated in FIG. 3, the lugs 78 displace 30° between adjacent recessed legs 92 of the slot 76. The lugs 78 are positioned between opposing rows of the recessed legs 92, with the rows being offset by 15° with respect to each other. The slot 76 displaces upwardly and downwardly along with the mandrel 68, causing the lugs 78 to alternately engage the opposing rows of recessed legs 92, and thereby causing the lugs to incrementally displace through the slot 76.

For example, a position of one of the lugs 78 is shown as 78*a* in FIG. 3 engaged with one of the legs 92 (certain positions of only one of the lugs 78 are shown in FIG. 3 for illustrative clarity, it being understood that the other lug is positioned 180° from the illustrated lug). This position 78*a* corresponds to an upwardly displaced position of the mandrel 68 as depicted in FIGS. 2A–C, in response to pressure being applied to flowpath 64. The pressure on flowpath 64 is relieved, and pressure applied to flowpath 62 then causes the mandrel 68 to displace downwardly (to the right as viewed in FIG. 3). The downward displacement of the mandrel forces the lug 78 to engage the opposite leg 92 of the slot 76. Inclined faces of the lug 78 and leg 92 cause the lug 78 to rotate to position 78*b,* 15° from position 78*a* about the mandrel 68.

Release of the pressure applied to flowpath 62 and subsequent application of pressure to flowpath 64 will cause upward displacement of the mandrel 68, thereby forcing the lug 78 to displace into engagement with an opposing leg 92, and also causing the lug to rotate another 150 about the mandrel 68. Therefore, it may be clearly seen that each alternating application of pressure to the flowpaths 62, 64 results in a 15° rotation of the lug 78 about the mandrel 68. Each pair of alternating applications of pressure to the flowpaths 62, 64 results in a 30° rotation of the lug 78. For example, from position 78*a* to another position 78*c* (150° total rotation) results from ten alternating applications of pressure to the flowpaths 62, 64, beginning with the flowpath 62.

Figure 4:
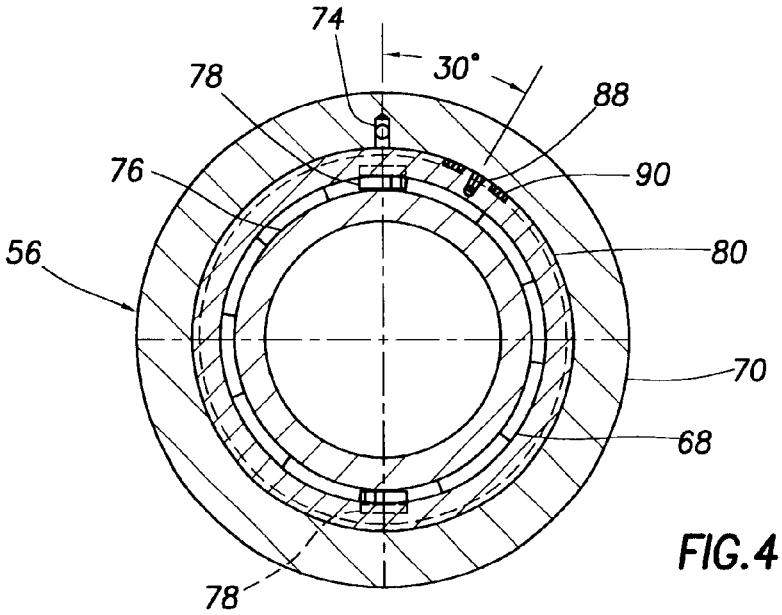
FIG. 4 is a cross-sectional view of a portion of the first control module, taken along line 4—4 of FIG. 2B, the portion being shown in a first position.

Referring additionally now to FIG. 4, a cross-sectional view of the control module 56 taken along line 4—4 of FIG. 2B is representatively illustrated. FIG. 4 depicts an initial position of the selector member 80 with respect to the housing 70. Note that, in this position, the opening 88 is offset from the flowpath 74 by 30°. Thus, the selector member 80 must be rotated 30° to provide fluid communication between the flowpaths 60, 74.

By applying pressure to the flowpath 64 to displace the mandrel 68 upward as shown in FIGS. 2A–C and thereby displace the lugs 78 to position 78*a* as shown in FIG. 3, releasing this pressure, and then applying pressure to the flowpath 62, the selector member 80 may be rotated 30° to provide fluid communication between the flowpaths 60, 74. Further rotation of the selector member 80 (by further alternating applications of pressure to the flowpaths 62, 64) will cause the opening 88 to rotate past the flowpath 74 and thereby prevent fluid communication between the flowpaths 60, 74.

Figure 5:
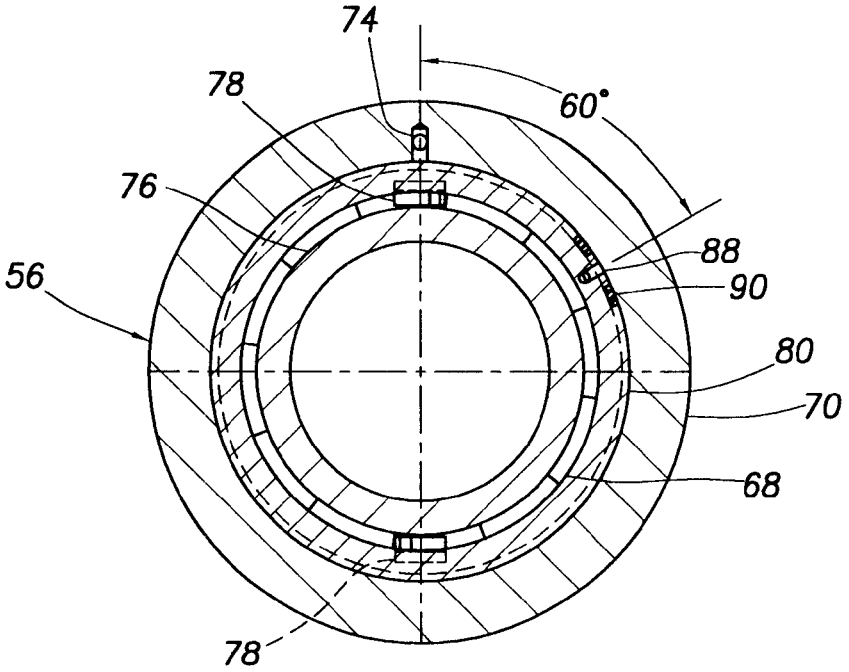
FIG. 5 is a cross-sectional view of the portion of the first control module, taken along line 4—4 of FIG. 2B, the portion being shown in a second position.

When the control module 56 is used for one of the control modules 18, 20, 22 in the method 10, the other control modules may be similarly constructed, but with differently configured selector members 80 that enable only one of the well tool assemblies 12, 14, 16 to be selected for actuation at a time. For example, FIG. 5 depicts a cross-section of the control module 56 in which the opening 88 is initially offset by 60° from the flowpath 74 (thus requiring four alternating pressure applications to the flowpaths 62, 64 to provide fluid communication between the flowpaths 60, 74). As another example, FIG. 6 depicts a cross-section of the control module 56 in which the opening 88 is initially offset by 330° from the flowpath 74 (thus requiring twenty-two alternating pressure applications to the flowpaths 62, 64 to provide fluid communication between the flowpaths 60, 74).

Figure 6:
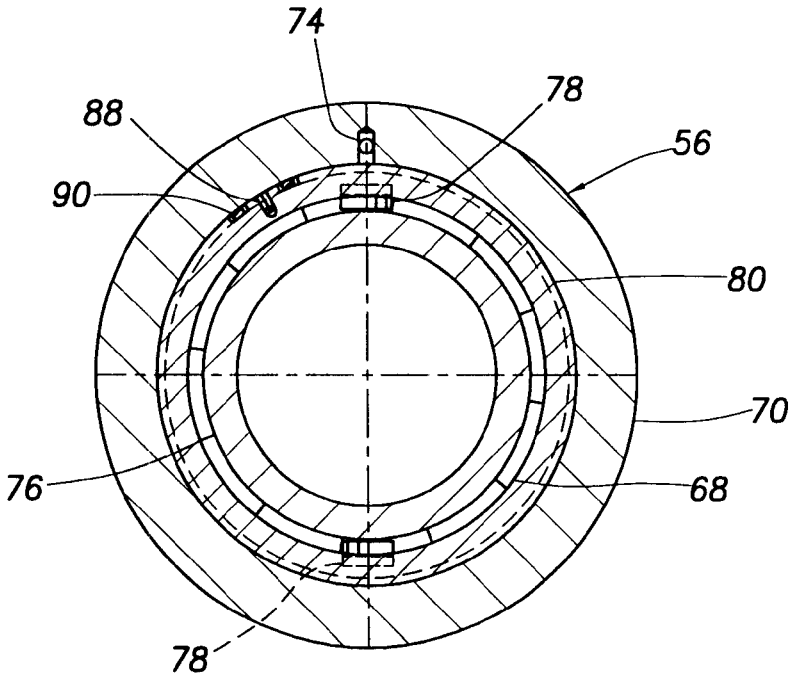
FIG. 6 is a cross-sectional view of the portion of the first control module, taken along line 4—4 of FIG. 2B, the portion being shown in a third position.

Note that, in each of the configurations shown in FIGS. 4–6, the initial position prevents fluid communication between the flowpaths 60, 74. In addition, since each pair of alternating applications of pressure to the flowpaths 62, 64 causes 30° rotation of the selector member 80, a total of twelve positions of the selector member relative to the housing 70 may be had in response to the alternating applications of pressure. If multiple differently configured selector members 80 are utilized in corresponding multiple control modules 56, and each selector member has an initial position in which fluid communication is prevented between the flowpaths 60, 74, then up to eleven uniquely configured selector members may be provided, so that only one of the control modules provides fluid communication between the flowpaths 60, 74 when the selector members rotate simultaneously.

Specifically, if eleven of the control modules 56 are used in a method such as the method 10, and each of the control modules is connected to the flowpaths 62, 64, so that all of the selector members 80 of the control modules rotate simultaneously, then each of the selector members will rotate 30° in response to each pair of alternating applications of pressure to the flowpaths 62, 64. By uniquely positioning the opening 88 in successive ones of the selector members 80 in increments of 30°, beginning with an offset of 30° from the flowpath 74 (as shown in FIG. 4) so that all of the selector members initially prevent fluid communication between the flowpaths 60, 74 in the corresponding control modules 56 before any alternating application of pressure to the flowpaths 62, 64, then only one of the flowpaths 74 will be in fluid communication with the flowpath 60 at a time, and all of the selector members may be positioned at the initial position to prevent fluid communication between the flowpaths 60, 74 in all of the control modules.

Of course, increments other than 300 may be provided, so that more or fewer unique configurations of the selector member 80 may be had. For example, the slot 76 maybe configured so that the adjacent legs 92 are positioned 20° or 36° apart. It is also not necessary to provide a position of all of multiple selector members 80 in which fluid communication is prevented between the flowpaths 60, 74.

Furthermore, more than one flowpath 74 may be in fluid communication with the flowpath 60 at a time, if desired.

Figure 2D:
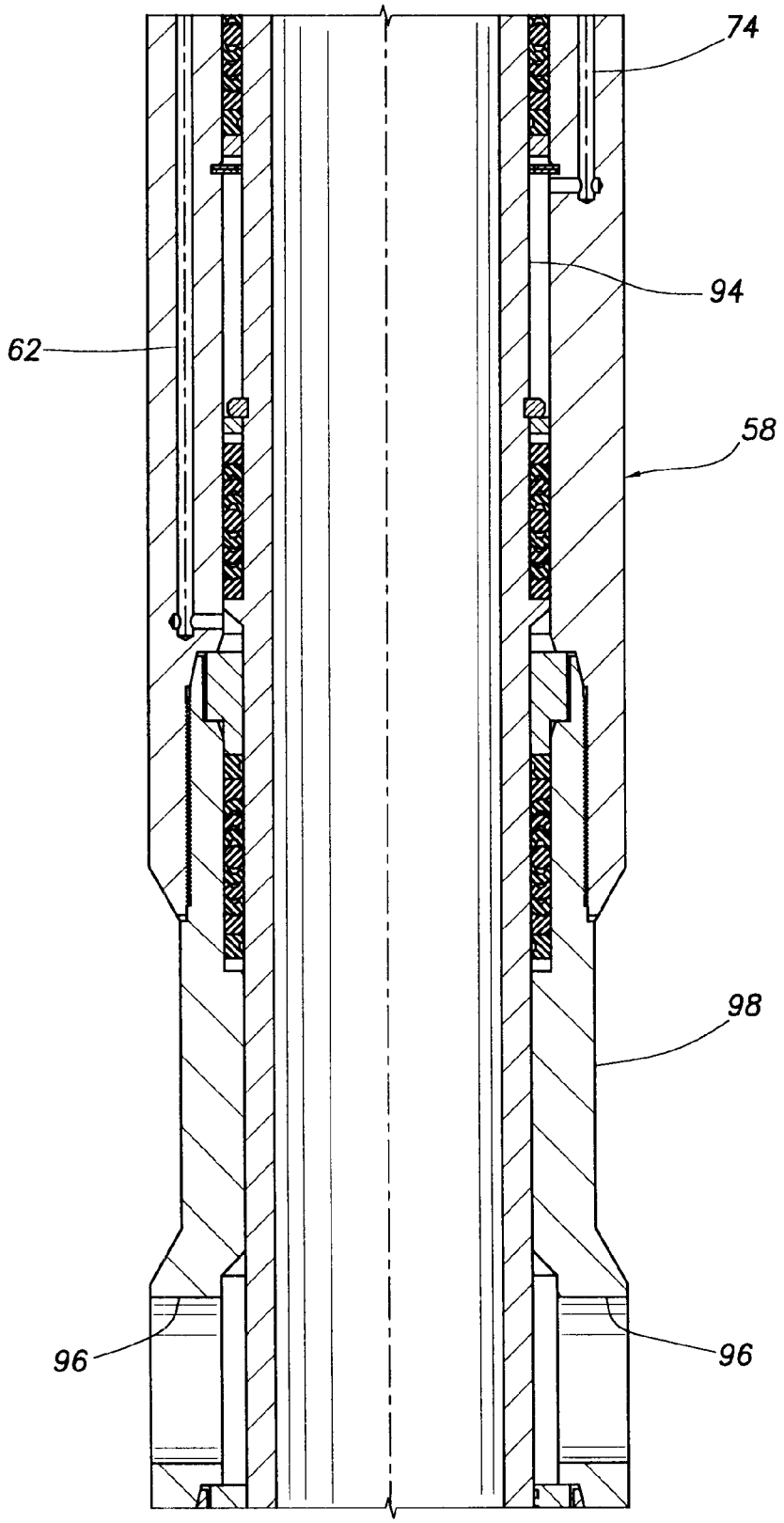
Figure 2E:
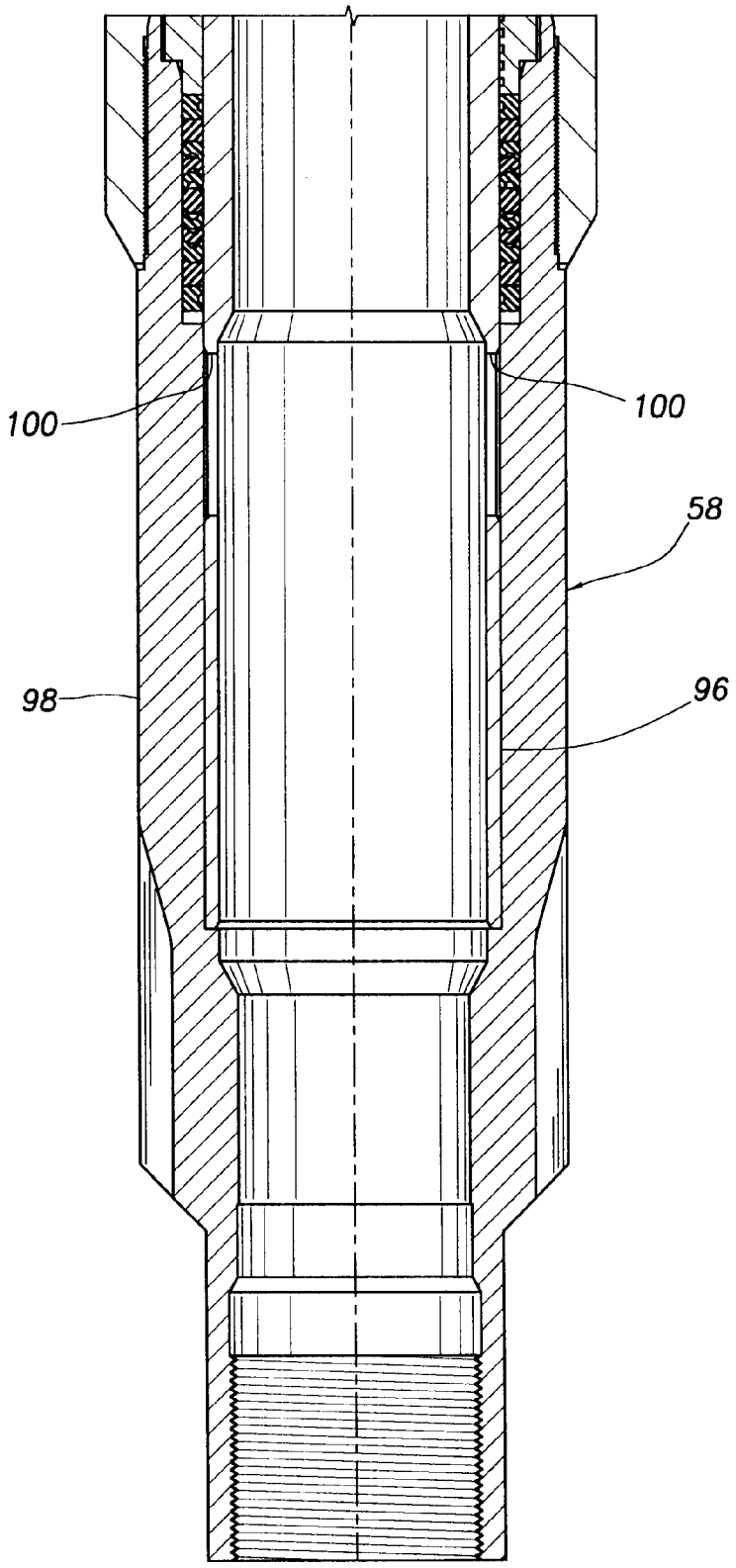

The flowpath 74 extends to the well tool assembly 58 for actuation thereof. Thus, when the flowpath 74 is in fluid communication with the flowpath 60, pressure on the flowpath 60 may be used to actuate the well tool assembly. As depicted in FIGS. 2C–E, pressure applied to the flowpath 74 biases a tubular sleeve 94 downwardly toward a position in which the sleeve blocks fluid flow through ports 96 formed through an outer housing assembly 98 of the well tool assembly 58, thereby preventing fluid flow therethrough. Pressure applied to the flowpath 62 biases the sleeve 94 upwardly toward a position in which ports 100 formed through the sleeve are aligned with the housing ports 96, thereby permitting fluid flow therethrough.

Thus, when the flowpath 74 is in fluid communication with the flowpath 60, pressure may be applied to the flowpath 60 to close the well tool assembly 58, or pressure may be applied to the flowpath 62 to open the well tool assembly. When the flowpath 74 is not in fluid communication with the flowpath 60, the flowpath 74 is isolated, thereby preventing displacement of the sleeve 94, and so pressure on the flowpath 62 does not affect the position of the sleeve. Of course, pressure on the flowpath 60 also does not affect the position of the sleeve 94 when the flowpath 74 is not in fluid communication with the flowpath 60.

If the control module 56 and well tool assembly 58 are used for the control modules 18, 20, 22 and respective well tool assemblies 12, 14, 16 in the method 10, each of the control modules may have a uniquely configured selector member 80, so that only one of the well tool assemblies 12, 14, 16 is selected at a time for actuation thereof in response to manipulations of pressure on the lines 24. Only three of the lines 24 would be required to select and control actuation of the well tool assemblies 12, 14, 16, each of the lines being connected to one of the flowpaths 60, 62, 64 of each of the control modules 18, 20, 22.

For example, if the selector member 80 of the control module 18 has its opening 88 offset 30° from the flowpath 74, then one pair of alternating applications of pressure to the flowpaths 62, 64 will cause the flowpath 60 to be placed in fluid communication with the corresponding flowpath 74, thereby permitting the well tool assembly 12 to be actuated by pressure on the flowpaths 60, 62 as desired. If the selector member 80 of the control module 20 has its opening 88 offset 60° from the flowpath 74, then two pairs of alternating applications of pressure to the flowpaths 62, 64 will cause the flowpath 60 to be placed in fluid communication with the corresponding flowpath 74, thereby permitting the well tool assembly 14 to be actuated by pressure on the flowpaths 60, 62. If the selector member 80 of the control module 22 has its opening 88 offset 90° from the flowpath 74, then three pairs of alternating applications of pressure to the flowpaths 62, 64 will cause the flowpath 60 to be placed in fluid communication with the corresponding flowpath 74, thereby permitting the well tool assembly 16 to be actuated by pressure on the flowpaths 60, 62. Thus, actuation of the well tool assemblies 12, 14, 16 may be selectively controlled by the control modules 18, 20, 22 in response to manipulations of pressure on three of the lines 24 connected to respective ones of the flowpaths 60, 62, 64 of each of the control modules.

Referring additionally now to FIGS. 7A–D, a well tool assembly 102 embodying principles of the present invention is representatively illustrated. The well tool assembly 102 is of the type known as a downhole variable choke, in that a flow rate therethrough may be varied. Specifically, the flow rate through the choke 102 may be varied by adjusting a flow area in response to pressure in flowpaths extending to any of the control modules described herein. Of course, the choke 102 may be used in other applications, with or without an associated control module, without departing from the principles of the present invention.

The choke 102 is described herein as if it is utilized in conjunction with the control module 56 described above. Thus, flowpaths 62*b* and 74 are shown as being connected to an upper end of the choke 102. As described above, pressure may be applied to the flowpaths 62*b*, 74 to actuate a well tool assembly connected to the control module 56 when the well tool assembly has been selected by the control module.

Pressure applied to flowpath 62*b* biases an inner tubular mandrel 104 in an upwardly direction, and pressure applied to flowpath 74 biases the mandrel in a downwardly direction as viewed in FIGS. 7A–D. The mandrel 104 is depicted in a downwardly disposed position in FIGS. 7A–C, as if pressure has been applied to flowpath 74.

A ratchet mechanism 106 controls displacement of the mandrel 104 relative to an outer housing assembly 108 of the choke 102. Pressure alternately applied to flowpaths 62*b*, 74 causes reciprocal displacement of the mandrel 104 within the housing 108, which also causes a lug 110 attached to the housing to advance incrementally through a J-slot 112 formed as an external circumferentially extending continuous recess on a sleeve 114. The sleeve 114 is rotatably disposed on the mandrel 104, so that, as the lug 110 advances through the J-slot 112, the sleeve rotates about the mandrel. Of course, other ratchet mechanisms, or other types of incremental displacement devices, may be used in the choke 102, without departing from the principles of the invention.

Figure 8:
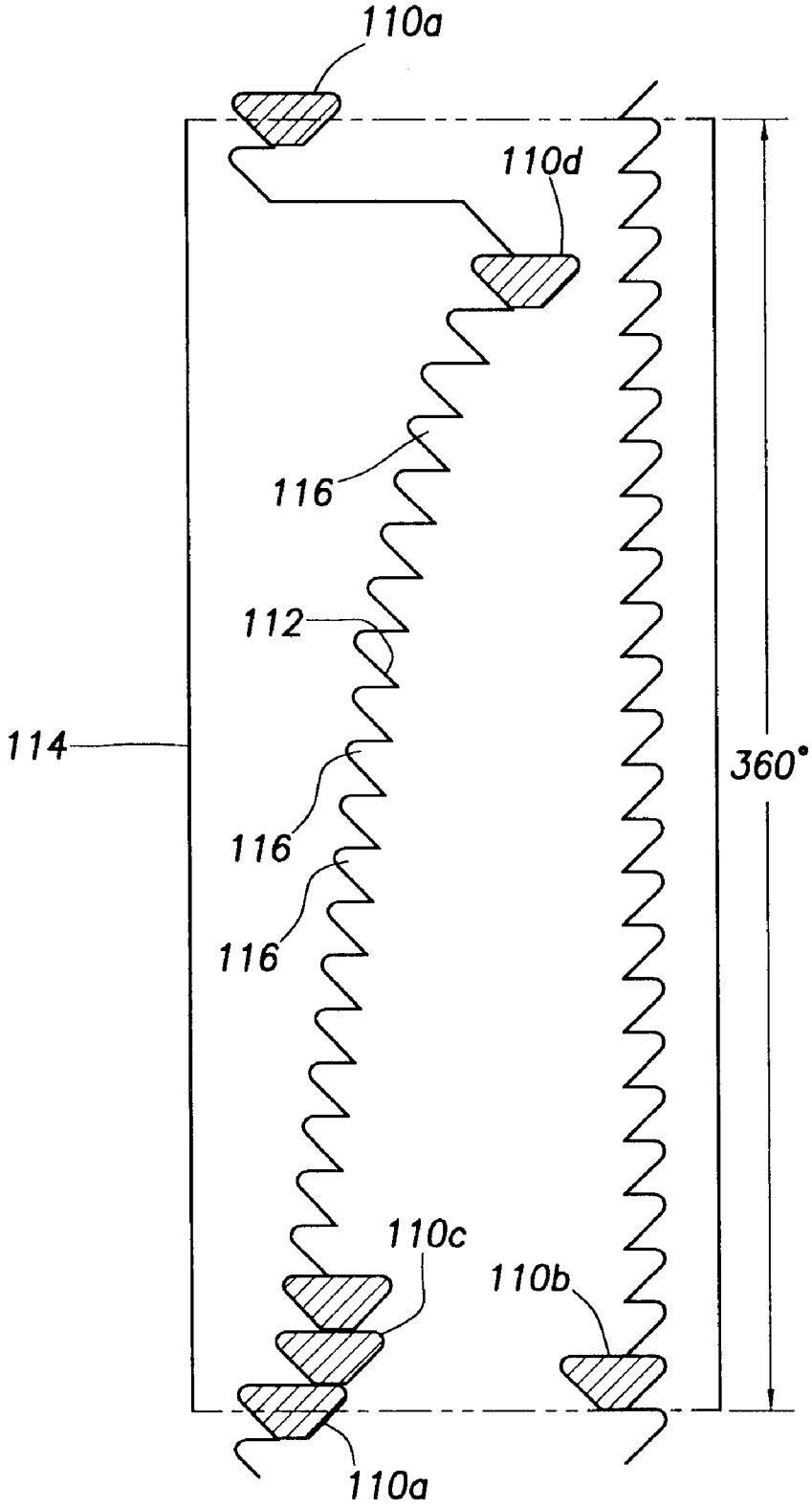
FIG. 8 is a plan "unrolled" view of a ratchet mechanism of the second well tool assembly.

In FIG. 8, the sleeve 114 is shown as if it were "unrolled", so that the entire 360° extent of the J-slot 112 may be viewed. Pressure applied to flowpath 74 causes the mandrel 104 and, thus, the sleeve 114 to displace to the right, and pressure applied to flowpath 62*b* causes the sleeve to displace to the left relative to the lug 110 as viewed in FIG. 8.

An initial position of the lug 110 is indicated as 110*a* in FIG. 8. Pressure applied to flowpath 62*b* will cause the sleeve 114 to displace upward (to the left in FIG. 8), thereby displacing the lug 110 to position 110*b*. When the lug 110 engages the sleeve 114 at position 110*b*, inclined faces formed on the lug and J-slot 112 cause the sleeve to rotate somewhat about the mandrel 104. Subsequent pressure applied to flowpath 74 will cause the sleeve 114 to displace downward (to the right in FIG. 8), thereby displacing the lug 110 to position 110*c*. When the lug 110 engages the sleeve 114 at position 110*c*, inclined faces formed on the lug and J-slot 112 again cause the sleeve to rotate somewhat about the mandrel 104. Thus, alternating applications of pressure to the flowpaths 62*b*, 74 cause the sleeve 114 to incrementally rotate about the mandrel 104 as the lug 110 advances through the J-slot 112.

Note that the lug 110 at position 110*c* is somewhat downwardly disposed relative to the lug at position 110*a*. Stated differently, the sleeve 114, and, thus, the mandrel 104, is more upwardly disposed relative to the lug 110, and, thus, the housing 108, when the lug is in position 110*c* as compared to when the lug is in position 110*a*. This is due to the fact that the J-slot 112 is formed with an inclined row of recessed legs 116 in which the lug 110 is received when pressure is applied to flowpath 74. Therefore, the mandrel 104 is incrementally positioned in successively more upwardly disposed positions relative to the housing 108 as the lug 110 advances through the J-slot 112.

Eventually, after a sufficient number of alternating applications of pressure to flowpaths 62*b,* 74 have been performed, the lug 110 will be positioned at position 110*d,* at which point the mandrel 104 will be at its most upwardly disposed position in response to pressure applied to flowpath 74. A subsequent application of pressure to flowpath 62*b* and then to flowpath 74 will result in the lug 110 again being positioned at its most upwardly disposed position relative to the sleeve 114, at which point the mandrel 104 will be at its most downwardly disposed position. Therefore, the mandrel 104 may be repeatedly and incrementally displaced axially relative to the housing 108 in response to applications of pressure to flowpath 74, alternated with applications of pressure to flowpath 62*b*.

Figure 7A:
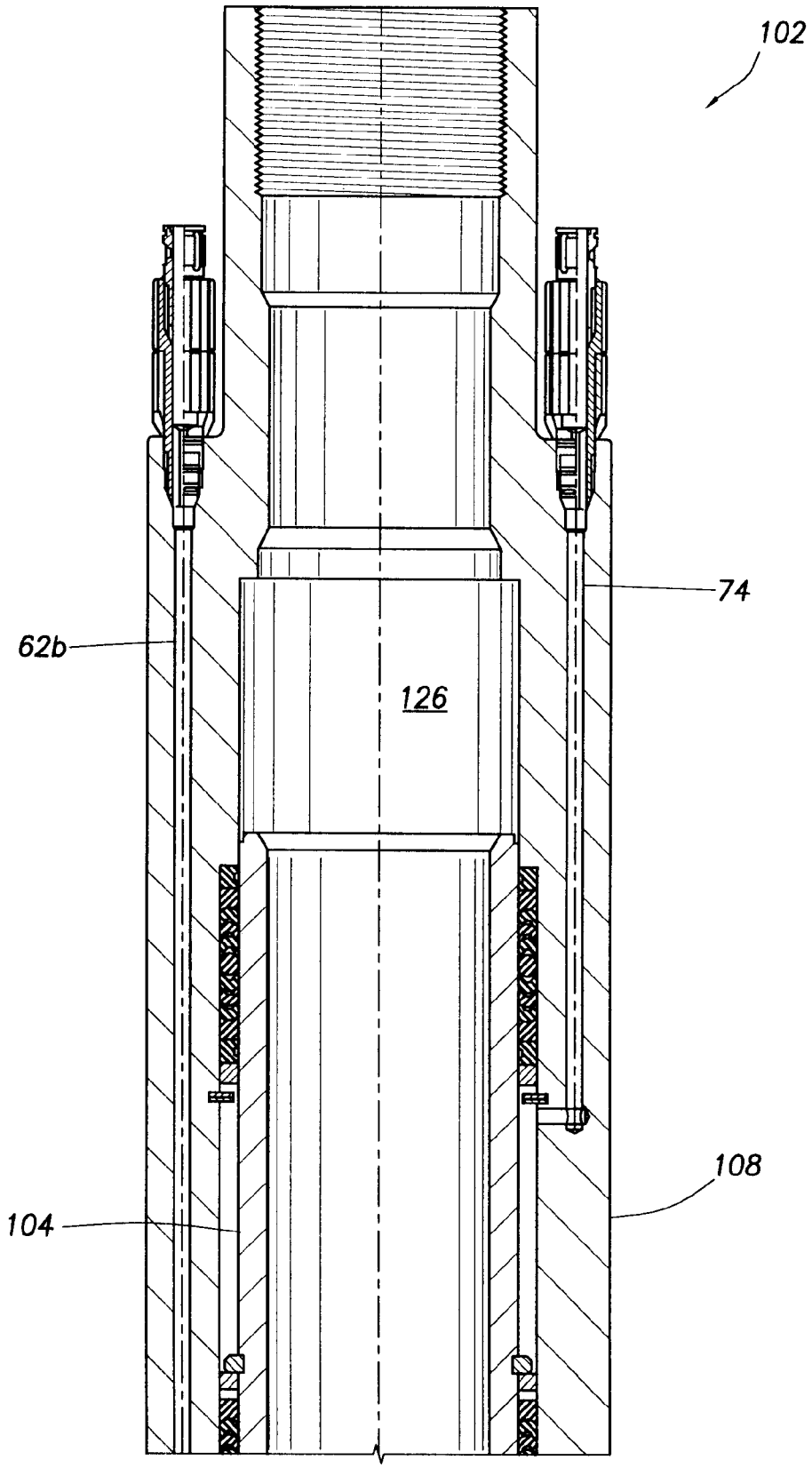
FIGS. 7A–D are cross-sectional views of successive axial sections of a second well tool assembly which may be operated using control modules described herein.
Figure 7B:
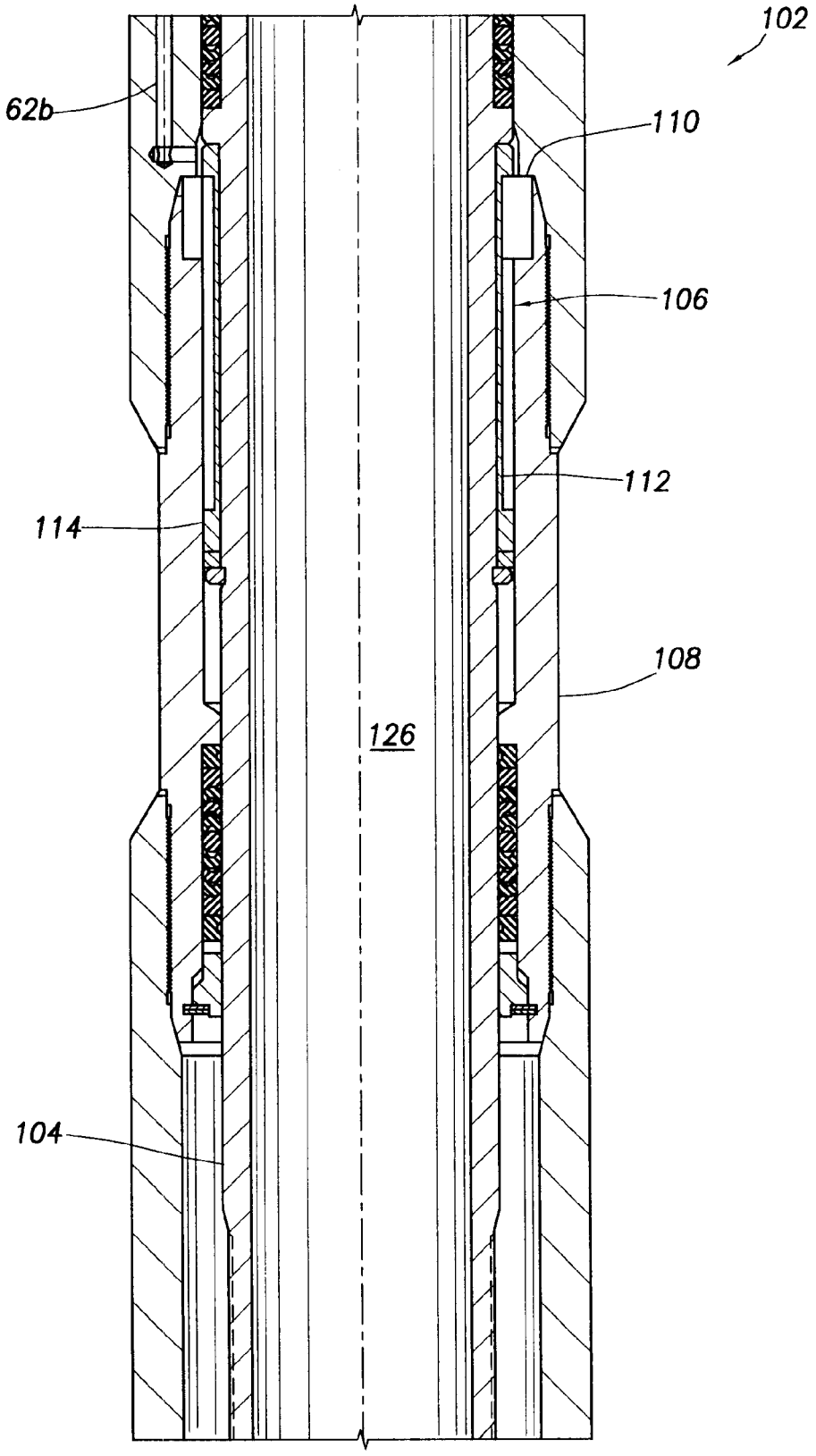
Figure 7C:
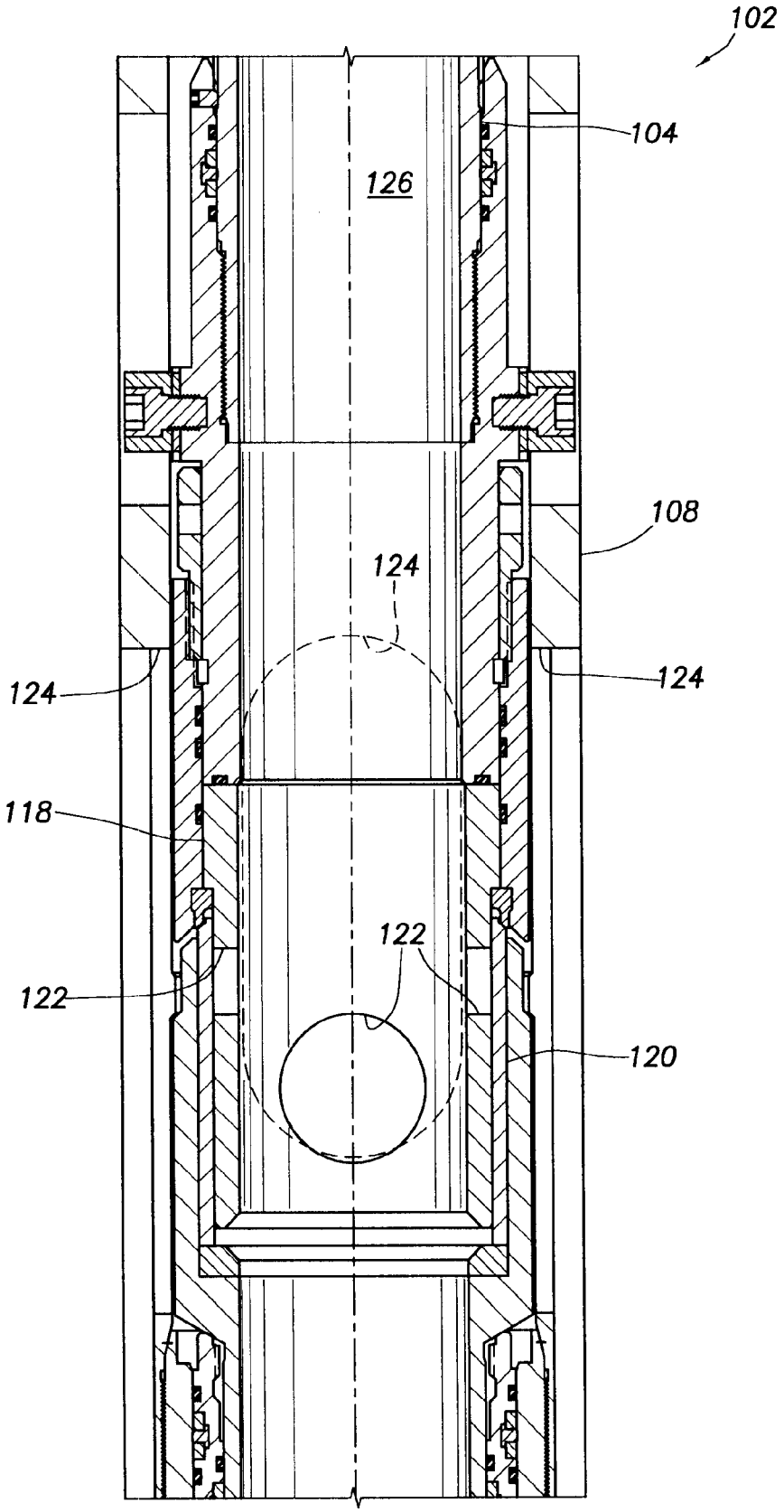
Figure 7D:
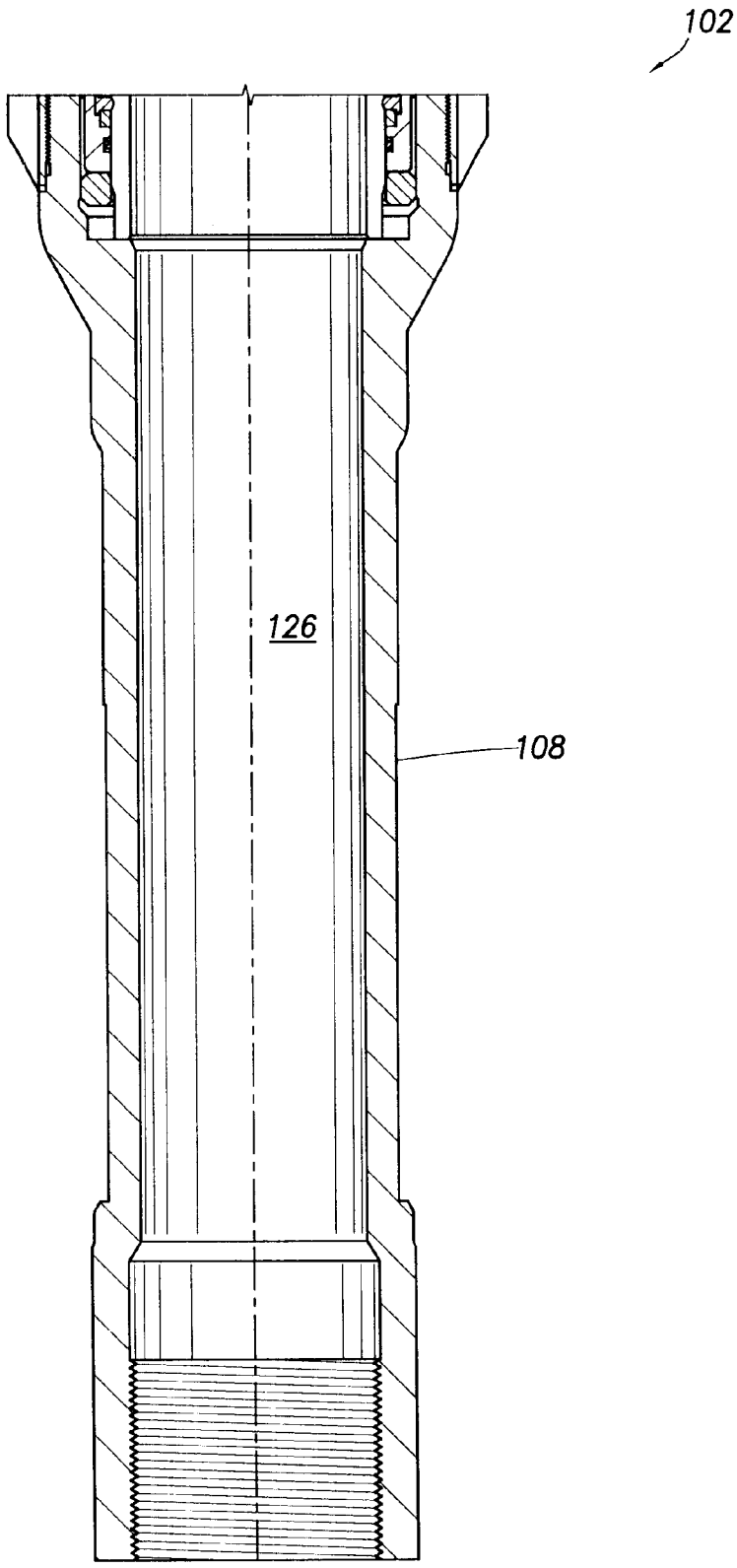

A generally tubular flow area trim member 118 is attached at a lower end of the mandrel 104. The trim member 118 is shown in FIG. 7C sealingly engaged with another generally tubular trim member 120 attached to the housing 108. With the trim members 118, 120 sealingly engaged as depicted in FIG. 7C, fluid flow through ports 122 formed through the trim member 118 is prevented and, thus, flow through ports 124 formed through the housing 108 is prevented.

However, if the mandrel 104 is displaced upwardly, the trim members 118, 120 will no longer be sealingly engaged and fluid flow between an interior flow passage 126 and the exterior of the housing 108 will be permitted via the ports 122, 124. Furthermore, the greater the upward displacement of the mandrel 104, the greater the flow area of the ports 122 that is exposed to such flow, and the greater the rate of fluid flow therethrough. Thus, by incrementally upwardly displacing the mandrel 104 in response to alternating applications of pressure to flowpaths 62*b,* 74 as described above, the flow area and flow rate through the choke 102 may be accurately adjusted as desired. In addition, by positioning the mandrel 104 in its most downwardly disposed position relative to the housing 108 (e.g., by positioning the lug 110 in position 110*a* as depicted in FIG. 8), the trim members 118, 120 may be sealingly engaged with each other to thereby prevent fluid flow through the choke 102.

Figure 9A:
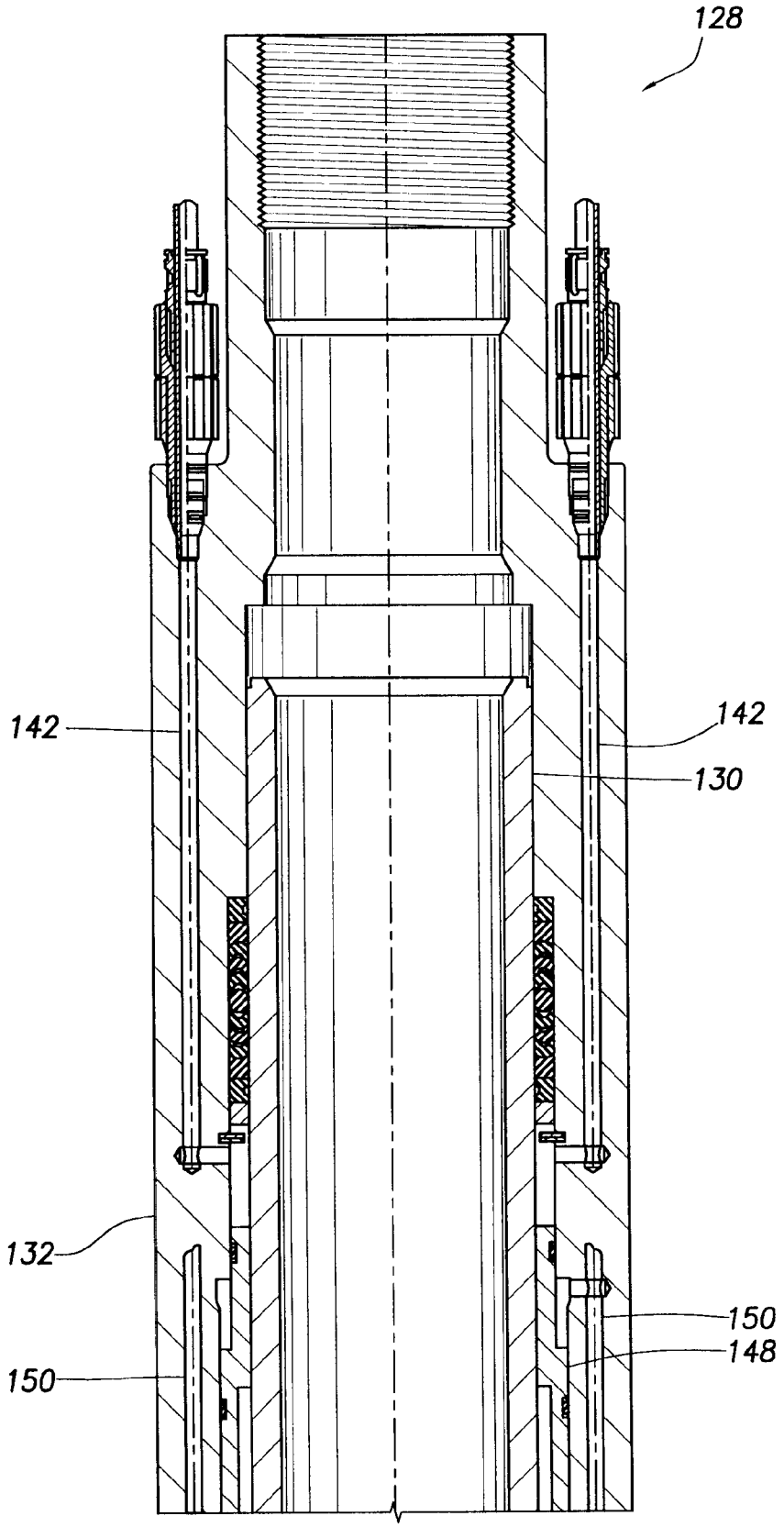
FIGS. 9A–C are cross-sectional views of successive axial sections of a second control module usable in the method of FIG. 1.
Figure 9B:
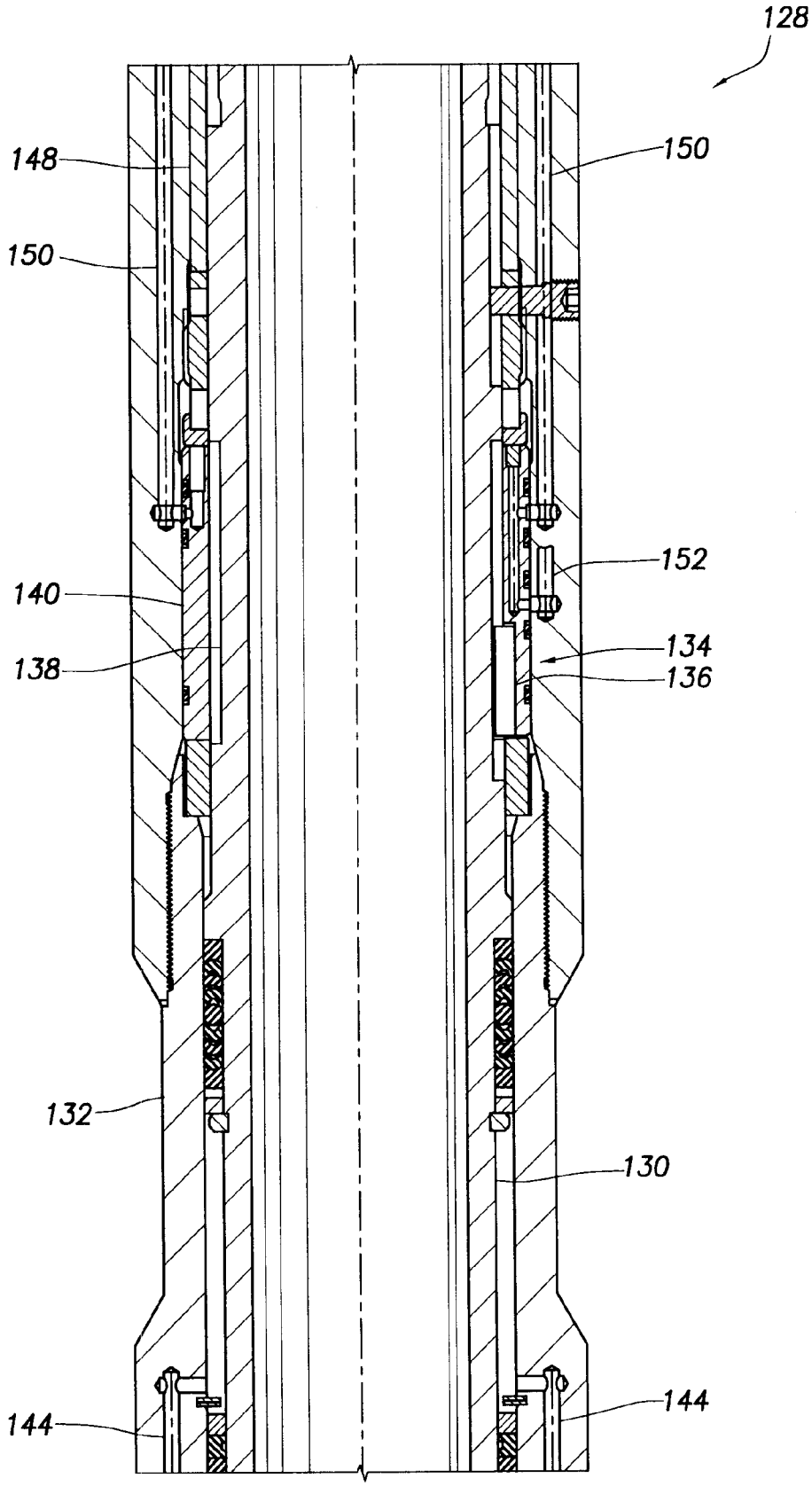
Figure 9C:
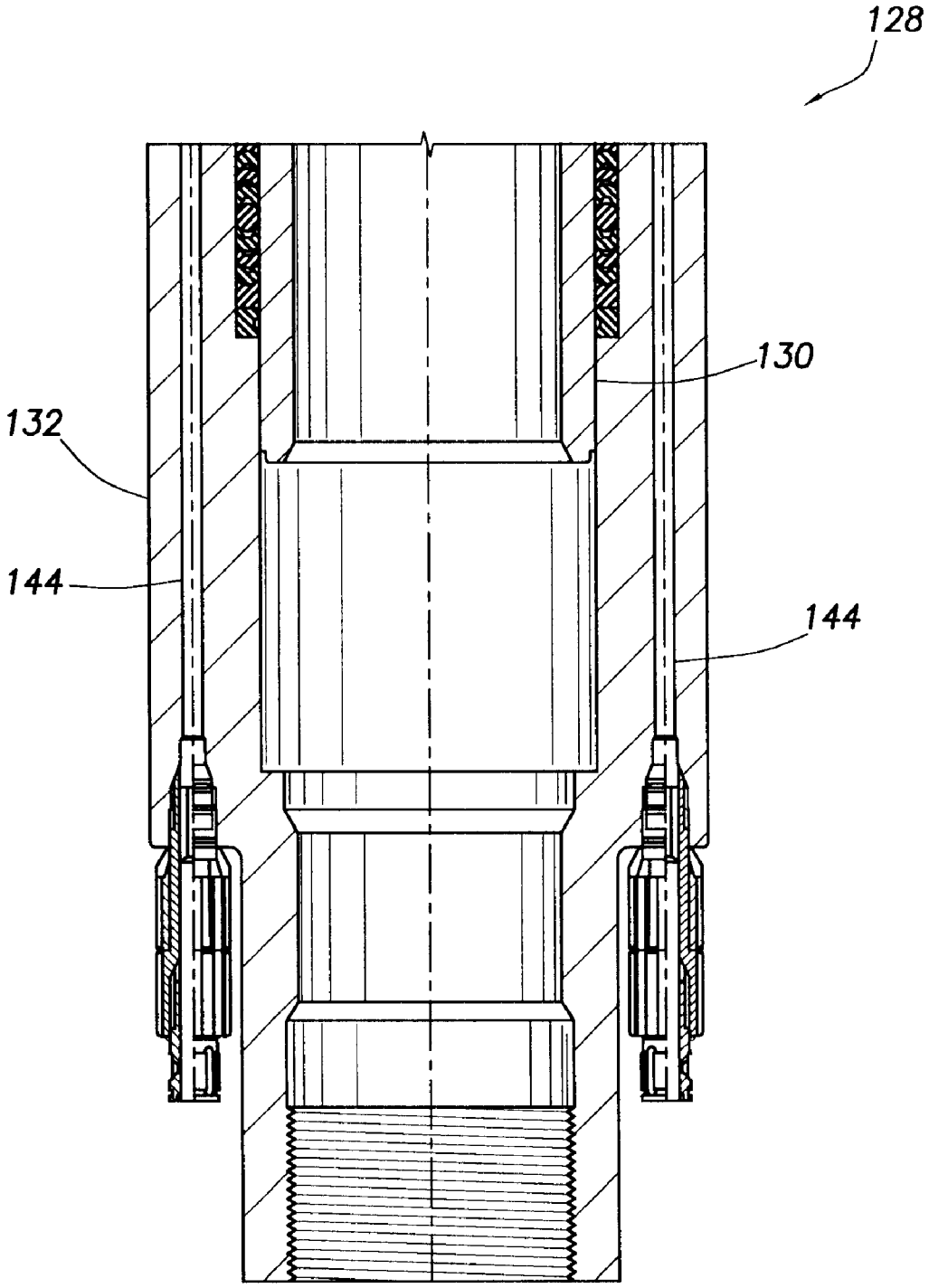

Referring additionally now to FIGS. 9A–C, another control module 128 embodying principles of the present invention is representatively illustrated. The control module 128 may be used for any of the control modules 18, 20, 22 in the method 10 to control selection and actuation of the well tool assemblies 12, 14, 16. However, it is to be clearly understood that the control module 128 may be used in other methods to control other well tool assemblies, without departing from the principles of the present invention.

The control module 128 is similar in many respects to the control module 56 described above. Specifically, the control module 128 includes a mandrel 130 which is reciprocated upwardly and downwardly within a housing assembly 132. The displacement of the mandrel 130 relative to the housing 132 is controlled by a ratchet mechanism 134. The ratchet mechanism 134 includes a lug 136 which incrementally advances through a J-slot 138 formed as a continuous circumferentially extending recess on the mandrel 130.

The lug 136 is attached to a generally tubular selector member 140 rotatably disposed within the housing 132. Pressure in a flowpath 142 biases the mandrel 130 downwardly relative to the housing 132, thereby displacing the J-slot 138 downwardly relative to the lug 136. Pressure in a flowpath 144 biases the mandrel upwardly relative to the housing 132, thereby displacing the J-slot 138 upwardly relative to the lug 136.

Figure 10:
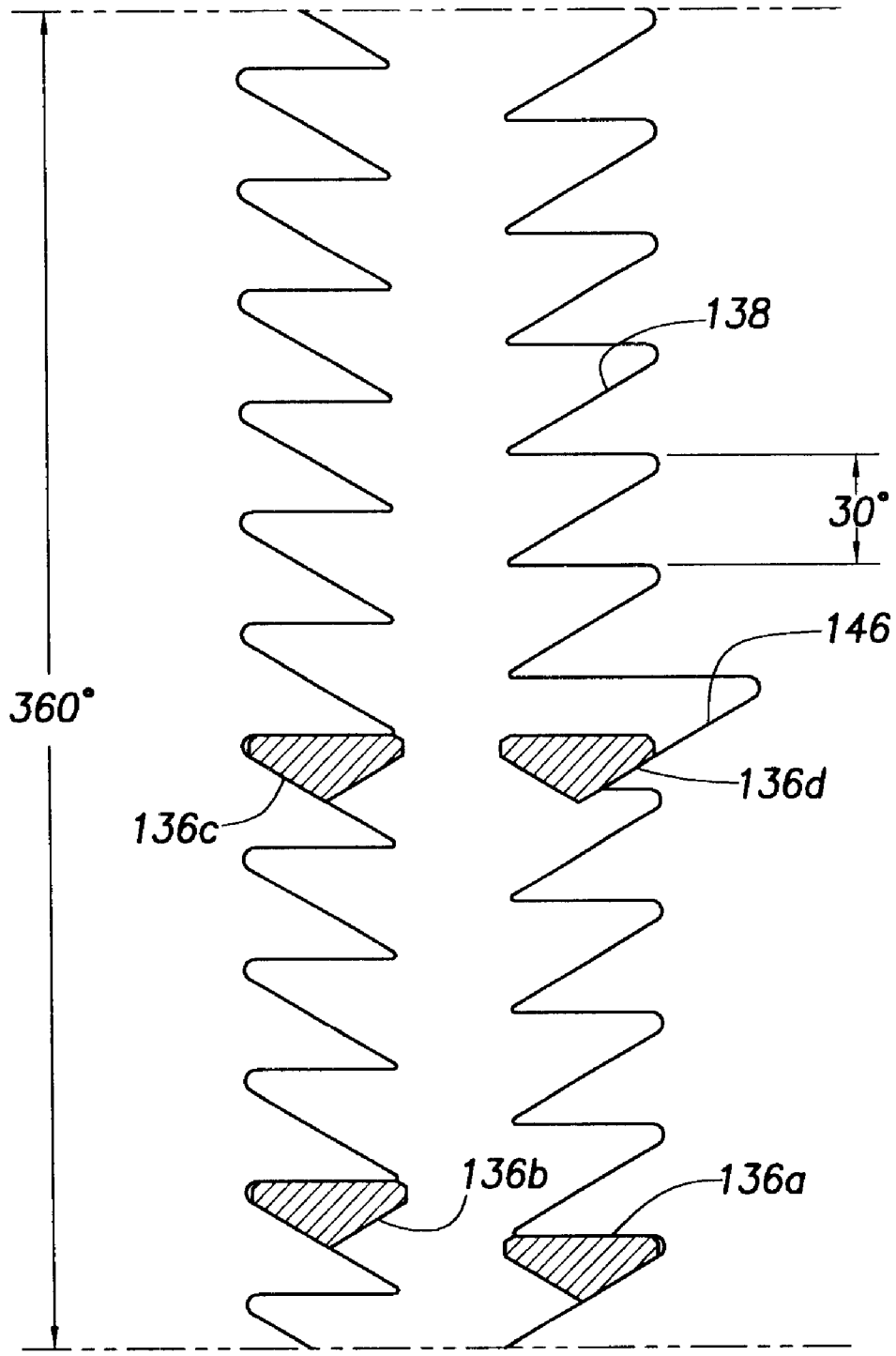
FIG. 10 is a plan "unrolled" view of a ratchet mechanism of the second control module.

The J-slot 138 is shown in FIG. 10 as if it has been "unrolled", so that its entire 360° extent may be viewed. Note that the lug 136 may incrementally advance through the J-slot 138 as described above for the J-slot 76 and lugs 78, for example, between positions 136*a* and 136*b* in response to applications of pressure to flowpaths 144 and 142, respectively (the J-slot displacing upwardly to the left as viewed in FIG. 10).

When, however, the lug 136 has advanced from a position 136*c* to a position 136*d,* further upward displacement of the J-slot 138 will be required before inclined faces formed on the lug and J-slot cooperate to rotate the selector member 140 to which the lug is attached. This is due to the fact that the J-slot 138 has a uniquely configured leg 146 which is deeper than other legs of the J-slot. This arrangement places the inclined face of the leg 146 further downward on the J-slot 138, so that the J-slot must displace further upward relative to the lug 136 for engagement with the lug to rotate the selector member 140.

This feature of the J-slot 138 is used in the control module 128 to enable synchronization of multiple selector members 140 in multiple control modules. For example, if one or more of multiple selector members 140 is out of synchronization with the other selector members (i.e., not all of the selector members have simultaneously rotated within the housings 132 in response to alternating pressure applications on the flowpaths 142, 144), it may prevent the control modules 128 from performing as desired, that is, it may prevent independent selection of well tool assemblies for actuation thereof.

If the mandrel 130 of each of the control modules 128 is prevented from displacing upwardly a sufficient distance for the lugs 136 to fully engage the legs 146 of the J-slots 138 and rotate the selector members 140, then when the lugs reach positions 136*c* in the J-slots, the lugs will repeatedly cycle between positions 136*c* and 136*d* in response to alternating applications of pressure to flowpaths 142, 144. The selector members 140 will all eventually reach the same rotational position relative to the housings 132 (since the lug 136 attached to each will eventually reach positions 136*c* and 136*d*), at which point the selector members will be synchronized.

The mandrel 130 is prevented from displacing upwardly a sufficient distance for the lug 136 to fully engage the leg 146 of the J-slot 138 by means of a generally tubular piston 148 sealingly engaged within the housing 132. The piston 148 is displaced downwardly relative to the housing 132 in response to pressure applied to a flowpath 150. This flowpath 150 is also used to supply fluid pressure to actuate a well tool assembly connected to the control module 128 via a flowpath 152 when the selector member 140 is appropriately radially aligned, in the same manner as the flowpath 60 supplies fluid pressure to actuate the well tool assemblies 58, 102 via the flowpath 74 when the selector member 80 is appropriately radially aligned.

When pressure is applied to flowpath 150, the piston 148 displaces downwardly, as shown in FIGS. 9A&B. With the piston 148 in its downwardly displaced position, it abuts the mandrel 130 when the lug 136 reaches position 136*d* in the J-slot 138 in response to pressure applied to flowpath 144, and prevents the lug from fully engaging the leg 146 of the J-slot, thus preventing the selector member 140 from rotating relative to the housing 132. When pressure is not applied to flowpath 150, the mandrel 130 is permitted to displace fully upwardly, so that the lug 136 fully engages the leg 146 of the J-slot 138, in response to pressure applied to flowpath 144.

Therefore, all of the selector members 140 of multiple control modules 128 connected to flowpaths 142, 144, 150 may be synchronized with each other by applying pressure to flowpath 150 and alternately applying pressure to flowpaths 142, 144. In this manner, all of the selector members 140 will eventually reach a position in which the lugs 136 are alternating between positions 136*c* and 136*d* in response to the alternating applications of pressure to flowpaths 142, 144. At that point, the pressure on flowpath 150 may be released, again permitting the selector members 140 to rotate simultaneously in response to alternating pressure on flowpaths 142, 144.

Referring additionally now to FIGS. 11A–G, another control module 154 and well tool assembly 156 embodying principles of the present invention are representatively illustrated. The control module 154 may be used for any of the control modules 18, 20, 22 and the well tool assembly 156 may be used for any of the well tool assemblies 12, 14, 16 in the method 10. Of course, each of the control module 154 and well tool assembly 156 may be used in other methods, and may be used with other respective control modules or well tool assemblies, without departing from the principles of the present invention.

The control module 154 is similar in many respects to the control modules 56, 128 described above, but differs in at least some respects in that only two lines or flowpaths 158, 160 are used to select and actuate a well tool assembly, multiple well tool assemblies may be selected using the control module and a different synchronization mechanism is provided which is responsive to different levels of pressure on the flowpaths.

A mandrel 162 is displaced upwardly and downwardly within a housing assembly 164 in response to pressure alternately applied to the flowpaths 158, 160. Pressure applied to flowpath 158 biases the mandrel 162 downwardly, and pressure applied to flowpath 160 biases the mandrel upwardly. A ratchet mechanism 166 controls rotational displacement of a tubular selector member 168 within the housing 164 in response to the reciprocal displacement of the mandrel 162. The ratchet mechanism 166 includes a lug 170 attached to the selector member 168 and engaged in a J-slot 172 formed as a continuous circumferentially extending recess on the mandrel 162.

Figure 12:
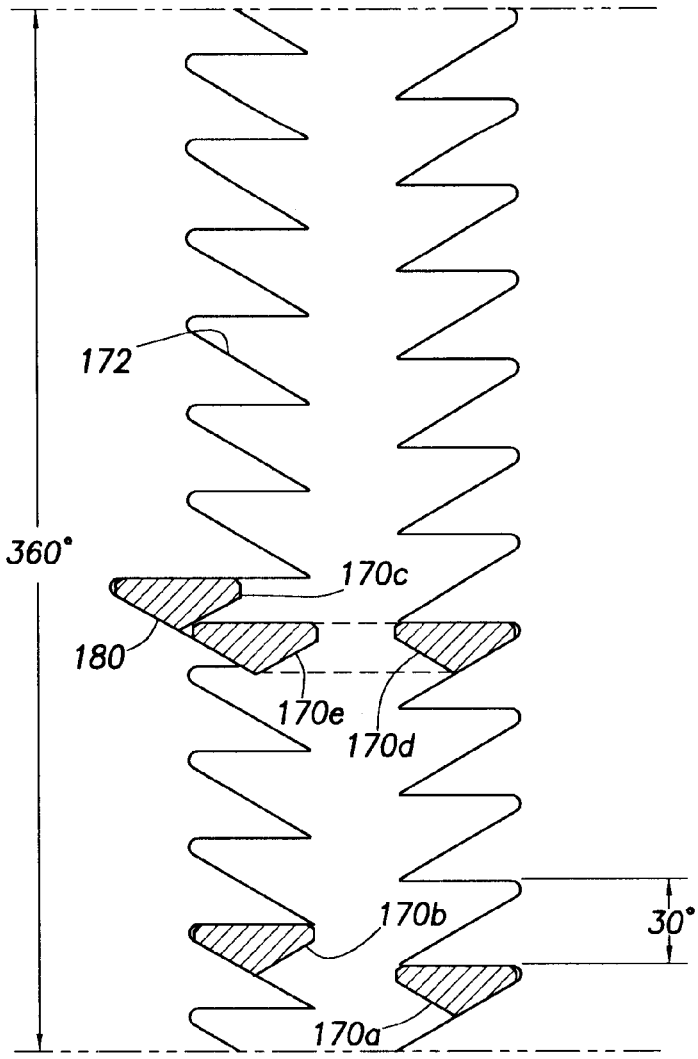
FIG. 12 is a plan "unrolled" view of a ratchet mechanism of the third control module.

The J-slot 172 is shown in FIG. 12 as if it has been "unrolled", so that its full 360° extent may be viewed. Pressure applied to flowpath 160 displaces the mandrel 162, and, thus, the J-slot 172, upwardly or to the left as viewed in FIG. 12. The lug 170, accordingly, displaces to a position 170*a*. Pressure applied to flowpath 158 displaces the mandrel 162 downwardly, thereby displacing the lug 170 to a position 170*b*. Thus, the selector member 168 attached to the lug 170 is incrementally rotationally displaced within the housing 164 in response to alternating applications of pressure to flowpaths 158, 160.

However, in a unique aspect of the control module 154, an increased level of pressure is required to displace the lug 170 from, for example, position 170*a* to 170*b*. This is due to the fact that an increased level of pressure on the flowpath 158 is required to downwardly displace the mandrel 162 a sufficient distance for the lug 170 to fully engage the J-slot 172 and rotate the selector member 168. The increased level of pressure required to downwardly displace the mandrel 162 is due to an upwardly biasing force exerted by a spring 174 disposed within the housing 164.

When the mandrel 162 displaces downwardly somewhat in response to pressure applied to flowpath 158, a shoulder 176 formed externally on the mandrel contacts a ring 178 positioned above the spring 174, so that further downward displacement of the mandrel compresses the spring. The mandrel 162 must compress the spring 174 in order for the selector member 168 to be rotated by engagement of the lug 170 with the J-slot 172. Thus, the selector member 168 will not rotate in response to pressure on the flowpath i58, unless that pressure is greater than a predetermined level.

This feature is used in the control module 154 to permit actuation of a well tool assembly connected to the control module in response to pressure on the flowpath 158, without that pressure causing the selector member 168 to rotate.

For example, if 3,000 psi must be applied to flowpath 158 to fully downwardly displace the mandrel 162 and cause the selector member 168 to rotate, then a pressure on flowpath 158 less than 3,000 psi may be used to actuate a well tool assembly connected to the control module 154 without causing the selector member to rotate.

The J-slot 172 of the control module 154 also includes a feature permitting synchronization of multiple selector members 168 of multiple control modules connected to the flowpaths 158, 160. Specifically, the J-slot 172 includes an increased depth leg 180, similar to the leg 146 of the J-slot 138 described above. The leg 180 prevents rotational displacement of the selector member 168 unless the mandrel 162 is displaced downwardly a sufficient distance for the lug 170 to fully engage the leg (to position 170*c* as shown in FIG. 12).

Since downward displacement of the mandrel 162 is already compressing the spring 174 when the lug 170 engages the other legs of the J-slot 172, it will be readily appreciated that an even greater level of pressure must be applied to flowpath 158 to further compress the spring and cause the lug to fully engage the leg 180 of the J-slot. Thus, the lug 170 will merely cycle between positions 170*d* and 170*e* as shown in FIG. 12 in response to alternating applications of pressure to flowpaths 158, 160, unless pressure is applied to flowpath 158 at a great enough level for the lug to fully engage the leg 180.

All of the selector members 168 of multiple control modules 154 may be synchronized by alternately applying pressure to flowpaths 158, 160, with the pressure applied to flowpath 158 being great enough to cause the lug 170 to fully engage all legs of the J-slot, except for the leg 180. In this manner, all of the selector members 168 will incrementally rotate within the housings 164, until they each reach a position in which the lug 170 is cycling between positions 170*d* and 170*e*. At this point, all of the selector members 168 will be synchronized, and pressure may be applied to flowpath 158 sufficiently great to fully engage the lug 170 with the leg 180 of the J-slot 172 and again simultaneously incrementally rotate the selector members 168.

Figure 13:
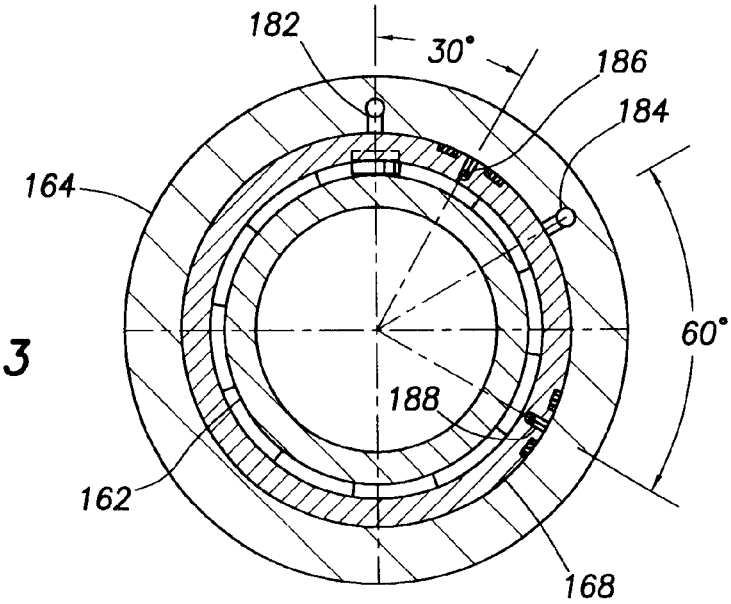
FIG. 13 is a cross-sectional view of a portion of the third control module, taken along line 13—13 of FIG. 11C, the portion being shown in a first position.

Referring additionally now to FIG. 13, a cross-sectional view of the control module 154 is representatively illustrated. In this view, it may be seen that two flowpaths 182, 184 are rotationally offset with respect to openings 186, 188 formed in the selector member 168. The openings 186, 188 are in fluid communication with the flowpath 160. When the opening 186 is radially aligned with flowpath 182, flowpaths 160 and 182 are in fluid communication. When the opening 188 is radially aligned with flowpath 184, flowpaths 160 and 184 are in fluid communication.

Figure 11A:
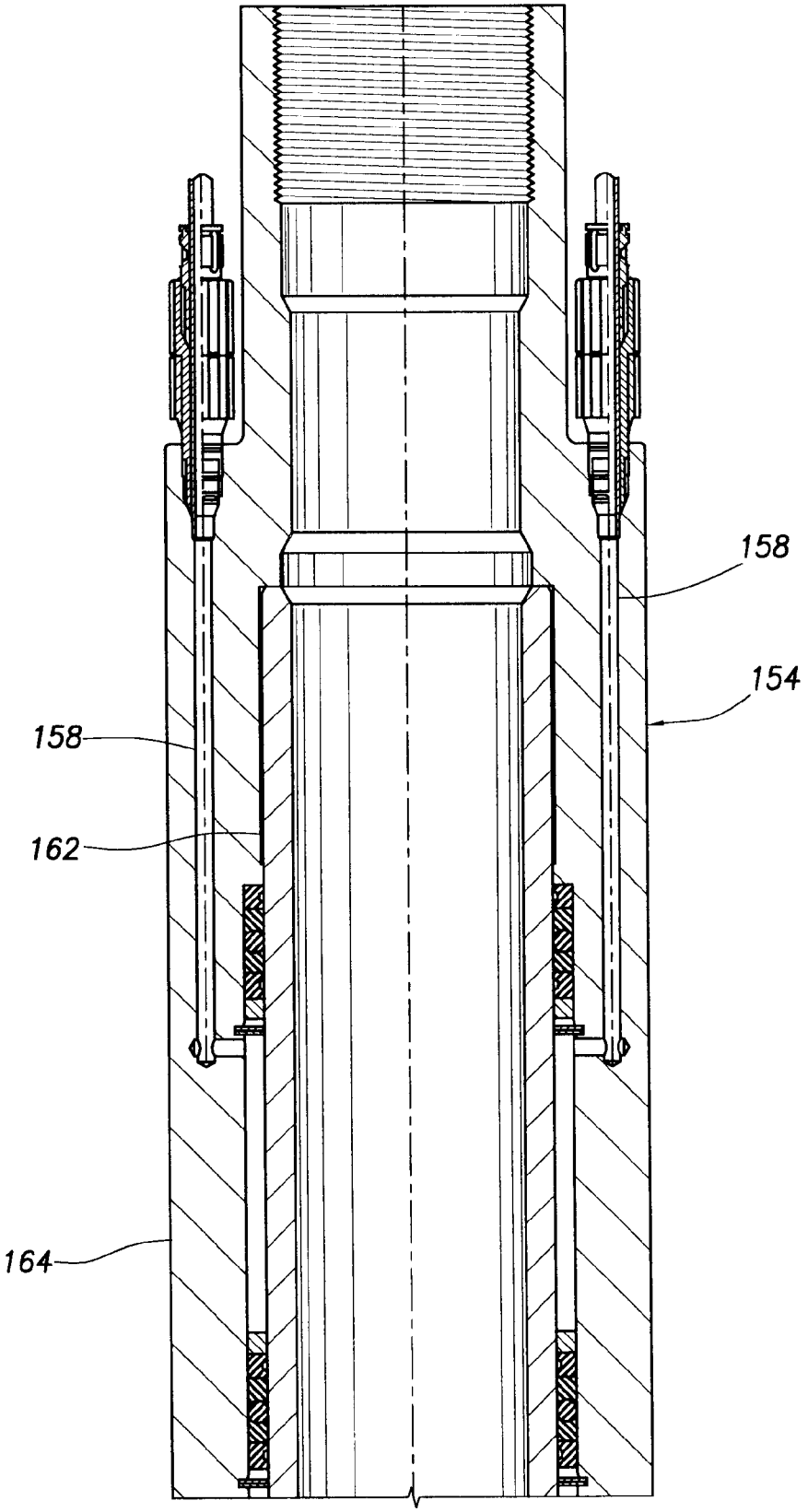
FIGS. 11A–G are cross-sectional views of successive axial sections of a third control module and well tool assembly usable in the method of FIG. 1.
Figure 11B:
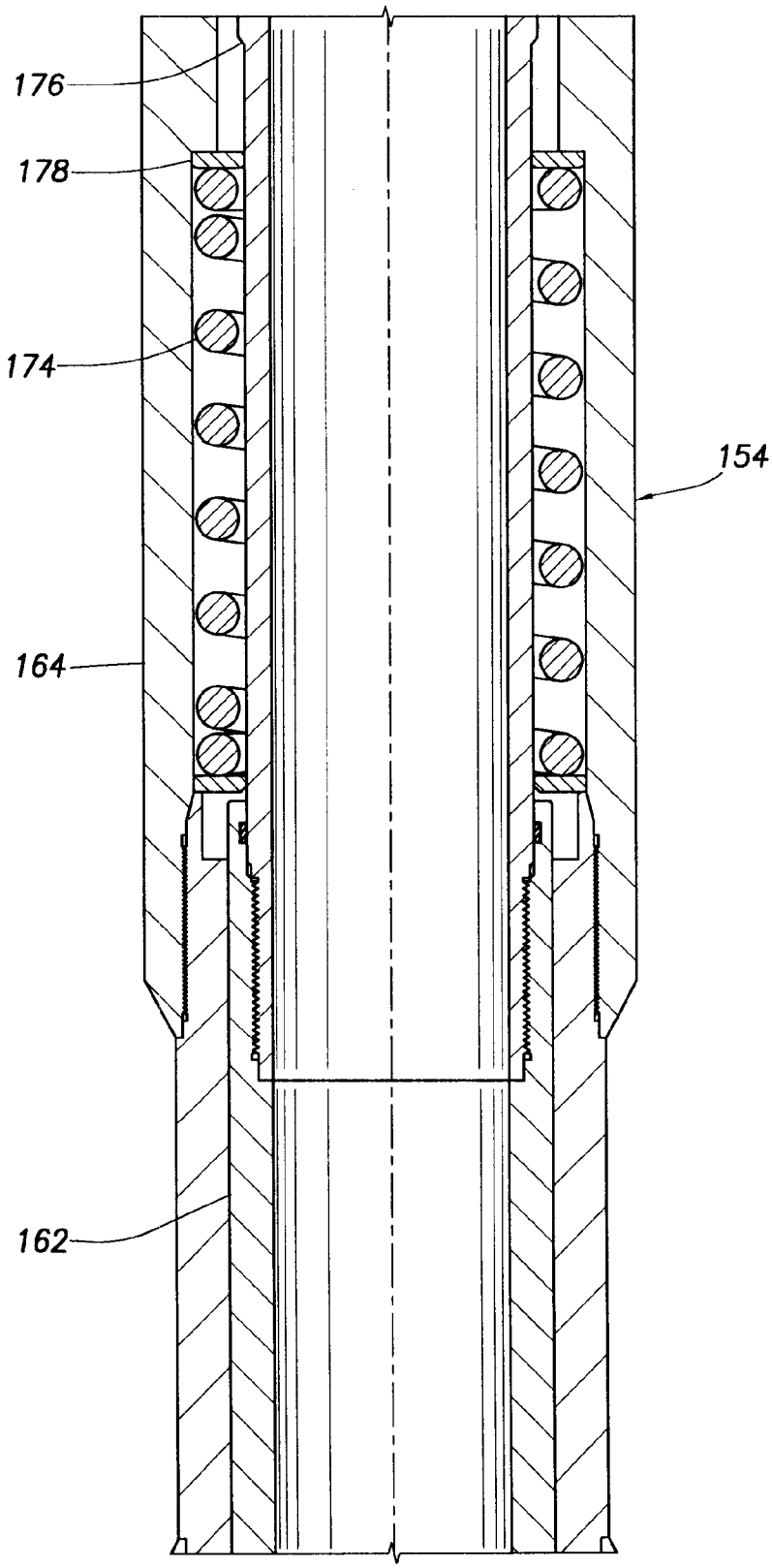
Figure 11C:
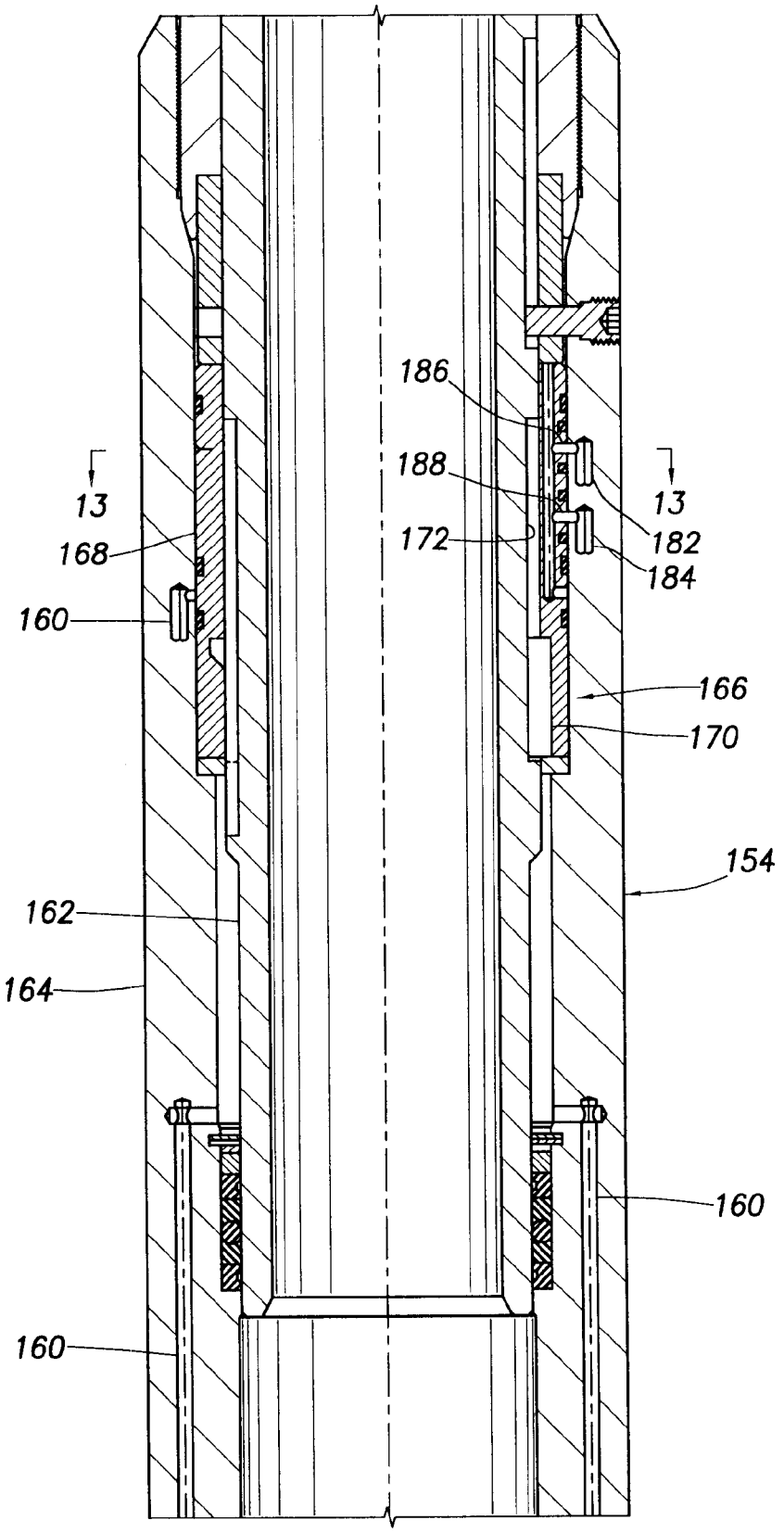
Figure 11D:
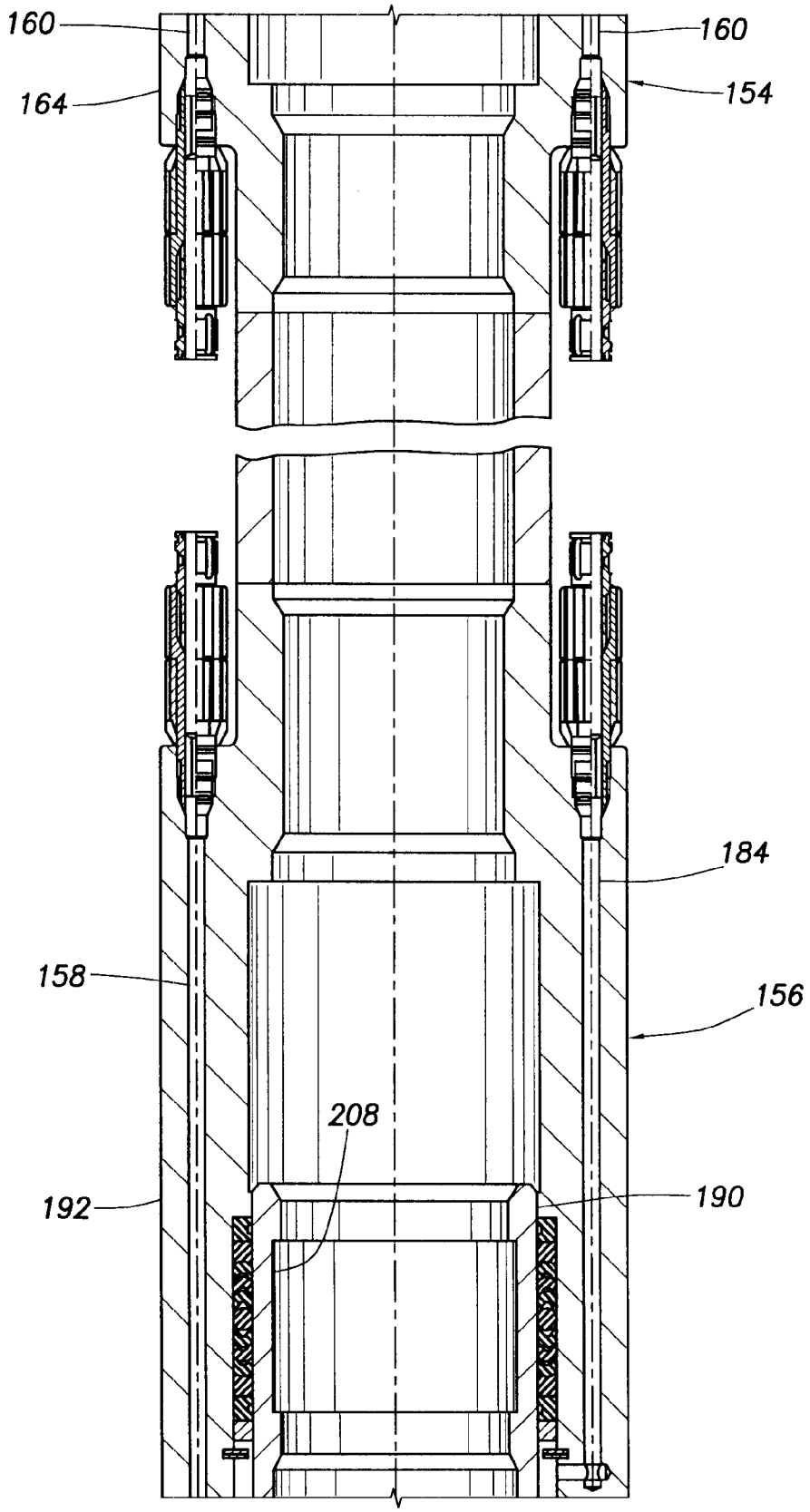
Figure 11E:
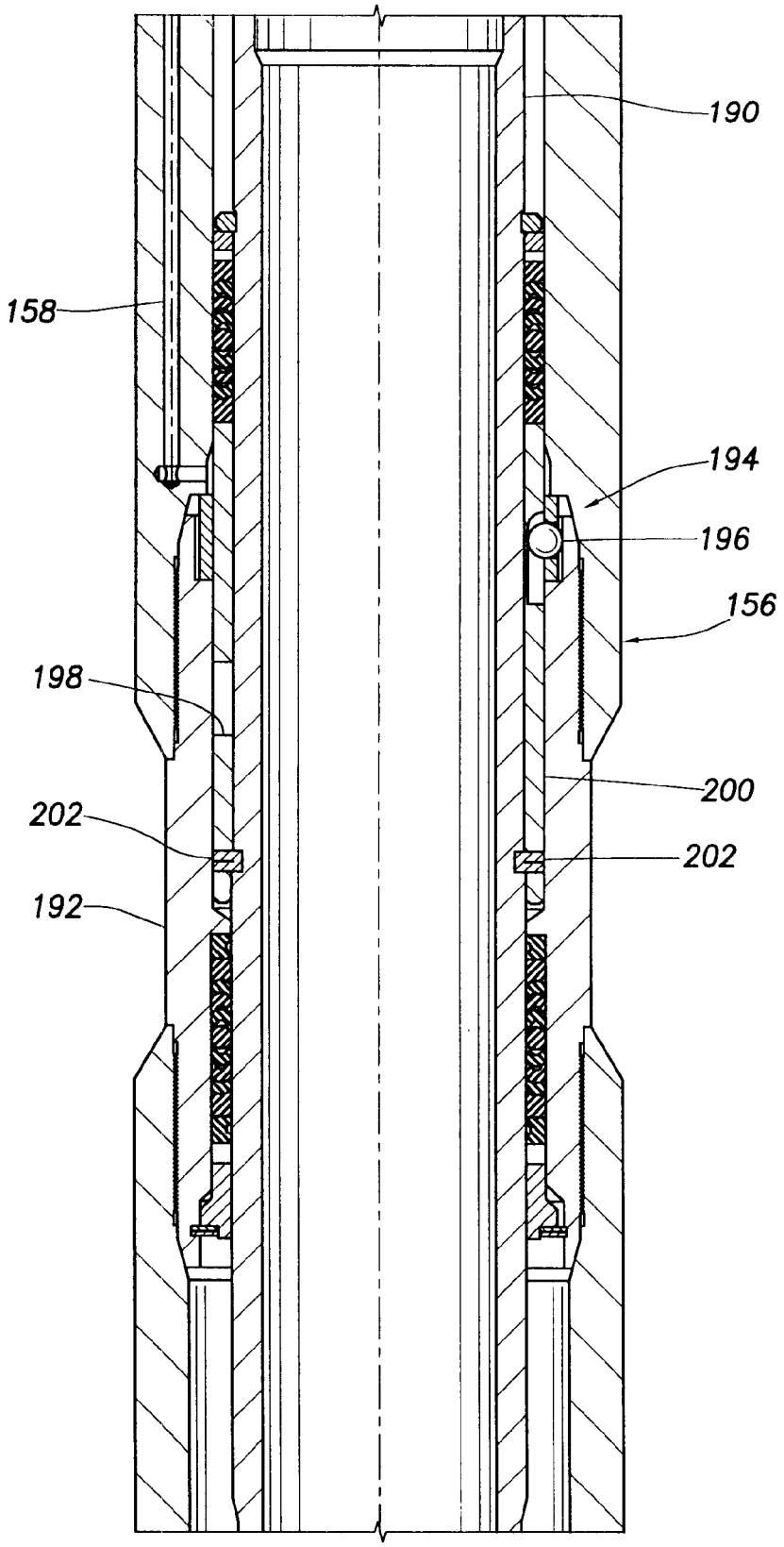
Figure 11F:
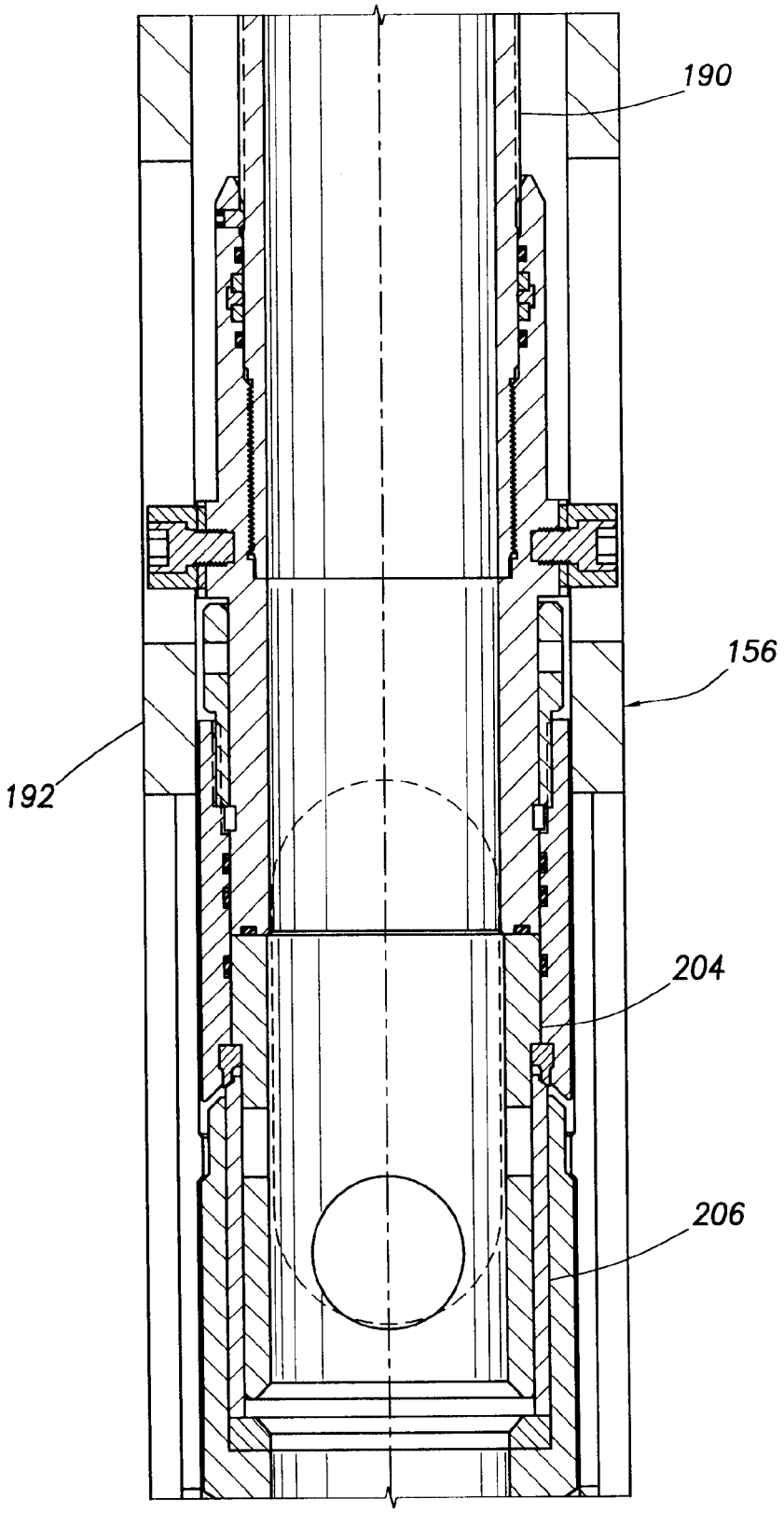
Figure 11G:
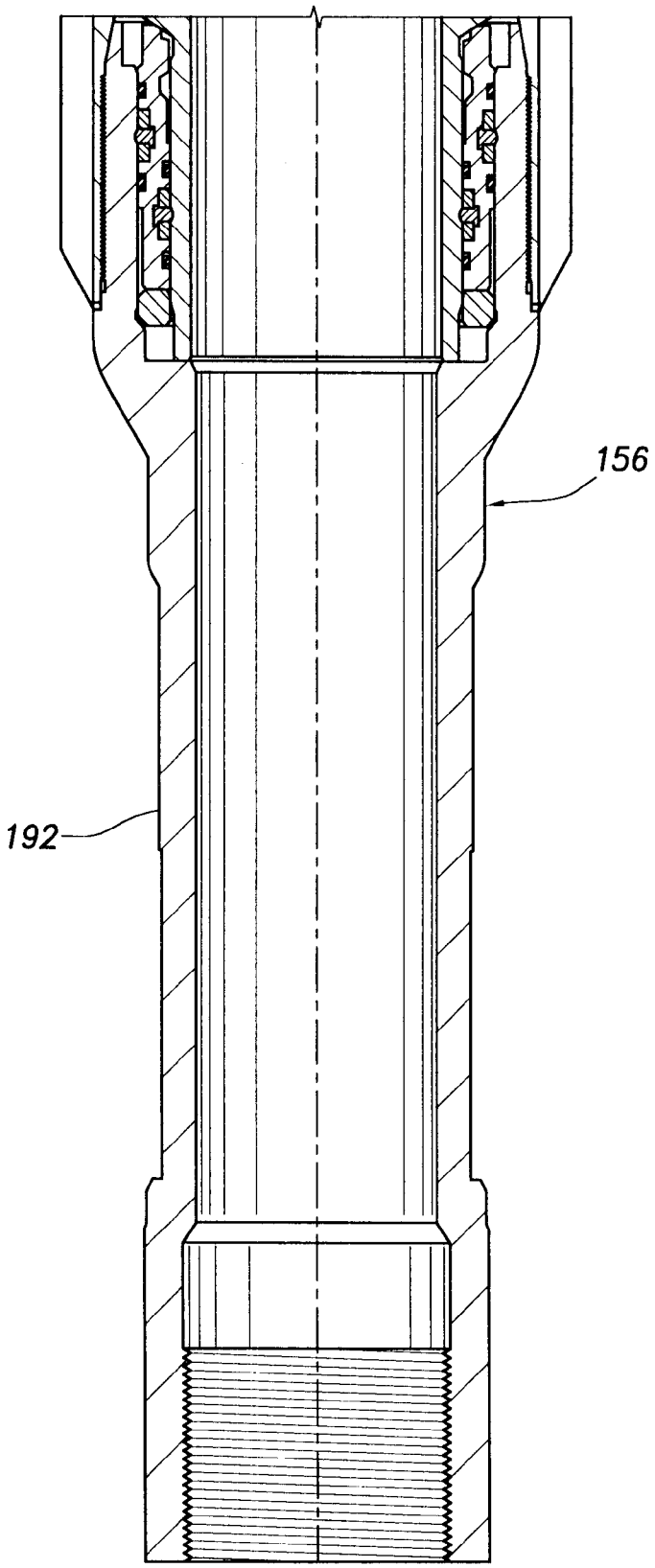

In FIG. 11C, the flowpaths 182, 184 are depicted as being axially aligned, so that the axial relationship between them may be clearly seen. However, the flowpaths 182, 184 are preferably radially offset, as depicted in FIG. 12, so that, as the selector member 168 rotates within the housing 164, flowpath 182 is not radially aligned with opening 186 at the same time as flowpath 184 is radially aligned with opening 188. In this manner, one well tool assembly connected to flowpath 182 for actuation thereof may be actuated by pressure on flowpath 160 when flowpath 182 is radially aligned with opening 186, and another well tool assembly may be actuated by pressure on flowpath 160 when flowpath 184 is radially aligned with opening 188.

If the control module 154 is used for each of the control modules 18, 20, 22 in the method 10, then flowpaths 182 may correspond to flowpaths 48, 50, 52 and flowpaths 184 may correspond to flowpaths 42, 44, 46. If each of the selector members 168 has its opening 186 initially radially offset the same amount relative to flowpath 182, then all of the packers 28, 30, 32 could be set simultaneously in response to pressure on flowpath 160. For example, if all of the openings 186 in the selector members 168 is radially offset 30° relative to flowpath 182 as depicted in FIG. 13, then upon 30° rotation of the selector members within the housings 164 (e.g., in response to alternating pressure applications to flowpaths 158, 160), all of the flowpaths 182 will be in fluid communication with flowpath 160, and all of the packers 28, 30, 32 may be set by pressure on flowpath 160.

Figure 14:
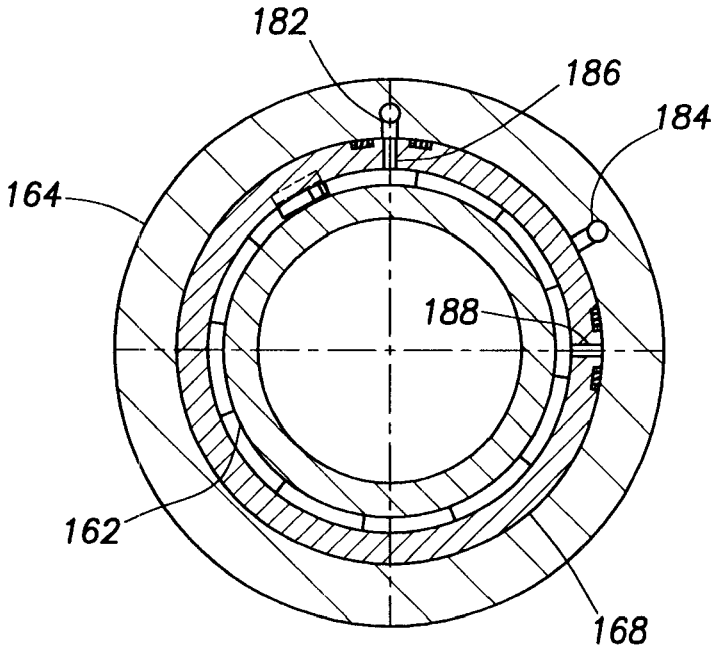
FIG. 14 is a cross-sectional view of the portion of the third control module, taken along line 13—13 of FIG. 11C, the portion being shown in a second position.
Figure 15:
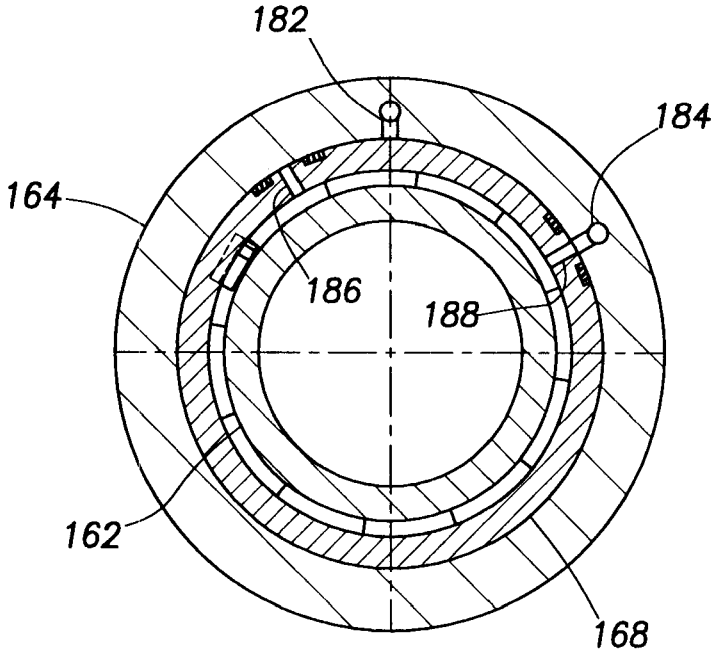
FIG. 15 is a cross-sectional view of the portion of the third control module, taken along line 13—13 of FIG. 11C, the portion being shown in a third position.

FIG. 14 shows the selector member 168 rotated 30° as compared to that shown in FIG. 13. In this view, the opening 186 is radially aligned with flowpath 182. Note that flowpath 184 is still 30° radially offset from the opening 188. In FIG. 15, the selector member 168 has been rotated another 30° (e.g., by another alternating pressure application to flowpaths 158, 160), thereby radially aligning flowpath 184 with the opening 188. Another well tool assembly may now be actuated by pressure on flowpath 160.

Where multiple control modules 154 are used to control selection and actuation of corresponding multiple well tool assemblies connected to flowpaths 184, the openings 188 in the selector members 168 may be uniquely positioned (each being uniquely radially offset with respect to the opening 188), so that only one of the well tool assemblies is selected at a time for actuation via flowpath 184, as described above for the control modules 56, 128. Of course, multiple well tool assemblies may be actuated by pressure on flowpath 184, without departing from the principles of the present invention.

The well tool assembly 156 shown in FIGS. 11D–G is of the type known as a variable choke, similar to the choke 102 described above. The choke 156 is shown in FIGS. 11D–G to illustrate how the flowpaths 158, 184 may be used in actuation of a well tool. In many respects, the choke 156 is similar to the choke 102, and the similar features will not be described again below.

Pressure on flowpath 158 biases a tubular mandrel 190 upwardly, and pressure on flowpath 160 biases the mandrel downwardly. Displacement of the mandrel 190 relative to an outer housing assembly 192 is controlled by a ratchet mechanism 194, which includes a ball 196 attached to the housing and received in a continuous circumferentially extending J-slot 198 formed in a sleeve 200 attached to the mandrel 190 by shear pins 202.

Figure 16:
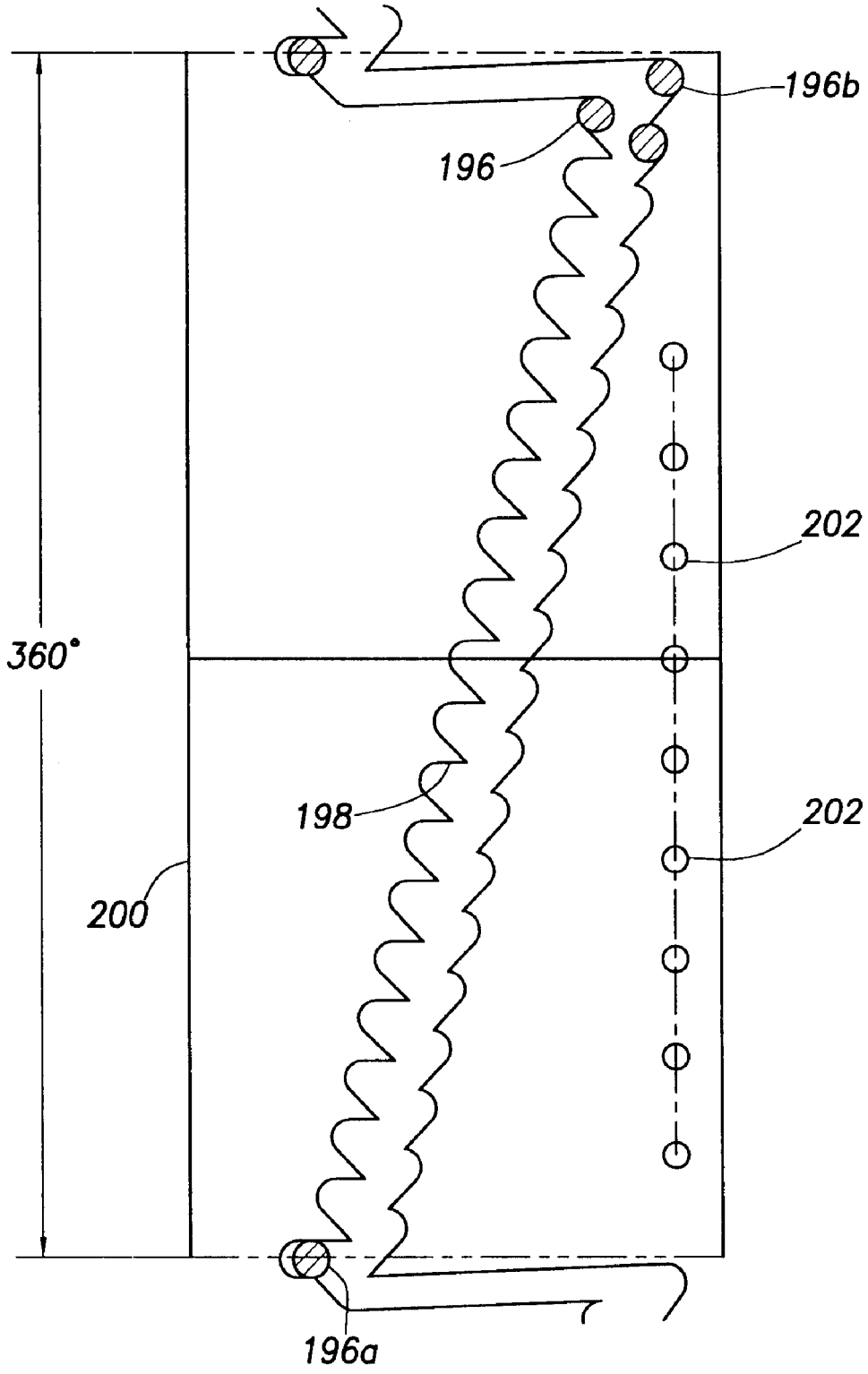
FIG. 16 is a plan "unrolled" view of a ratchet mechanism of the third well tool assembly.

The J-slot 198 is shown in FIG. 16 as if it is "unrolled", so that its entire 360° extent may be viewed. The ball 196 is depicted in various positions in the J-slot 198 in FIG. 16. As the mandrel 190 reciprocates in the housing 192 in response to alternating application of pressure on flowpaths 158, 184, the ball 196 incrementally displaces through the J-slot 198, thereby incrementally displacing the mandrel axially with respect to the housing. For example, with the ball 196 at position 196*a* the mandrel 190 is fully downwardly displaced in response to pressure applied to flowpath 184 and trim members 204, 206 are closed to flow therethrough. With the ball 196 at position 196*b* the trim members 204, 206 are fully open, due to the mandrel 190 being fully upwardly displaced relative to the housing 192.

An internal profile 208 is formed at an upper end of the mandrel 190. The profile 208 permits the mandrel 190 to be displaced relative to the housing 192 by a conventional shifting tool (not shown) engaged with the profile. A sufficient force may be applied to the mandrel 190 via the shifting tool to break the shear pins 202 and thereby permit the mandrel to be displaced independently of the ratchet mechanism, if desired, to operate the choke 156 manually.

In each of the control modules 56, 128, 154 described above, a flowpath 74, 152, 184, respectively, extending to a well tool assembly has been placed in fluid communication with another flowpath 60, 150, 160, respectively extending to a remote location. However, it will be readily appreciated that the flowpaths 74, 152, 184 may alternatively extend to other locations, such as an inner flow passage of the tubing string 26 or the annulus 54 in the method 10. For example, it may be desirable to configure the flowpath 74 to be in fluid communication with the inner flow passage of the tubing string 26 so that, when the flowpath 60 is placed in fluid communication with the flowpath 74, pressure in the flow passage of the tubing string may be monitored at the remote location via the flowpath 60.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A hydraulic control system for controlling operation of multiple well tool assemblies interconnected thereto, the system comprising:

multiple control modules, each of the control modules being interconnected to a corresponding one of the well tool assemblies, each of the control modules being interconnected between at least one first flowpath extending to a remote location and at least one second flowpath extending to the corresponding well tool assembly, and each of the control modules including a member which displaces in response to pressure on the first flowpath, each of the members being displaceable between a first position in which fluid communication is permitted between the first and second flowpaths, and at least one second position in which fluid communication between the first and second flowpaths is prevented, wherein in the second position of the member the second flow path is isolated from fluid communication therewith, thereby preventing actuation of the corresponding well tool assembly.

2. The system according to claim 1, wherein each member displaces simultaneously in response to pressure on the first flowpath.

3. The system according to claim 1, wherein there are two of the first flowpaths interconnected to each of the control modules, and wherein pressure is applied alternately to the two first flowpaths to thereby incrementally displace each of the members.

4. The system according to claim 3, wherein the alternate application of pressure to the two first flowpaths operates a ratchet mechanism of each of the control modules, each of the ratchet mechanisms controlling displacement of a corresponding one of the members.

5. The system according to claim 1, wherein in the second position of the member, the second flowpath is isolated from fluid communication therewith, thereby preventing actuation of the corresponding well tool assembly.

6. The system according to claim 1, wherein there are multiple ones of the first flowpaths, one of the first flowpaths being continually in fluid communication with each of the well tool assemblies, and another of the first flowpaths being in fluid communication with one of the second flowpaths only when a corresponding one of the members is in the first position.

7. The system according to claim 1, wherein only one of the members is in the first position at a time.

8. The system according to claim 1, wherein there are multiple ones of the first flowpaths and at least one of the well tool assemblies is a valve, the valve closing in response to pressure on one of the first flowpaths when a corresponding one of the members is in the first position, and the valve opening in response to pressure on another of the first flowpaths when the corresponding one of the members is in the first position.

9. The system according to claim 1, wherein at least one of the well tool assemblies is a variable choke, a flow area of the choke being varied in response to pressure on the at least one first flowpath when a corresponding one of the members is in the first position.

10. The system according to claim 9, wherein the choke includes a ratchet mechanism, the ratchet mechanism incrementally displacing a trim structure of the choke to thereby vary the flow area of the choke in response to repeated pressure applications on the at least one first flowpath.

11. The system according to claim 1, wherein there are multiple ones of the first flowpaths, and wherein pressure on one of the first flowpaths causes each of the members to cease displacing in response to pressure on another of the first flowpaths when the member has reached a predetermined position.

12. The system according to claim 1, wherein no two of the members are in the first position at the same time.

13. The system according to claim 1, wherein each of the members has a single third position in which a first predetermined minimum pressure must be on the first flowpath to displace the member.

14. The system according to claim 13, wherein each of the members has multiple ones of the second positions in which a second predetermined pressure less than the first predetermined pressure on the first flowpath displaces the member.

15. The system according to claim 14, wherein a third predetermined pressure less than the second predetermined pressure on the first flowpath operates the corresponding well tool assembly of each control module when the corresponding member is in the first position.

16. The system according to claim 1, wherein each control module further has at least one third flowpath connected thereto, and wherein each member further has a third position in which fluid communication is permitted between the first and third flowpaths.

17. The system according to claim 16, wherein all of the members are simultaneously displaceable to the third position.

18. The system according to claim 17, wherein there are multiple ones of the third flowpaths, and wherein each of the third flowpaths is connected to one of multiple hydraulically actuated packers, whereby all of the packers are settable by applying pressure to the first flowpath when the members are in the third position.

19. The system according to claim 1, wherein at least one control module further has a third flowpath connected thereto, and wherein the corresponding member further has a third position in which fluid communication is permitted between the first and third flowpaths.

20. The system according to claim 19, wherein the third flowpath is connected to an interior flow passage of a tubular string, whereby pressure in the flow passage is monitorable from the remote location via the first flowpath.

21. The system according to claim 19, wherein the third flowpath is connected to an annulus formed between a tubular string and a wellbore, whereby pressure in the annulus is monitorable from the remote location via the first flowpath.

22. A flow control device for use in a subterranean well, comprising:

a ratchet mechanism operable in response to pressure applied thereto; and a member incrementally displaceable by the ratchet mechanism, displacement of the member progressively varying a flow area through the flow control device.

23. The flow control device according to claim 22, wherein a variation of flow area through the flow control device in response to pressure is repeatable by the ratchet mechanism.

24. The flow control device according to claim 23, wherein the ratchet mechanism includes a continuous J-slot, the variation of flow area through the flow control device repeating as the ratchet mechanism repeatedly cycles through the ratchet mechanism.

25. The flow control device according to claim 22, wherein the ratchet mechanism displaces the member to a position in which flow through the flow control device is prevented.

26. A method of controlling operation of multiple well tool assemblies positioned in a well, the method comprising the steps of:

interconnecting multiple control modules to the well tool assemblies, each of the control modules being connected to a corresponding one of the well tool assemblies, and each of the control modules including a member displaceable between a first position and at least one second position, the corresponding well tool assembly being operable when the member is in the first position, and the corresponding well tool assembly being inoperable when the member is in the second position; and displacing the members simultaneously in response to pressure on at least one first flowpath interconnected to the control modules.

27. The method according to claim 26, wherein the displacing step further comprises displacing the members one at a time to the first position.

28. The method according to claim 26, wherein the displacing step further comprises displacing the members sequentially to the first position.

29. The method according to claim 26, wherein the interconnecting step further comprises connecting each of the control modules to at least one second flowpath extending to the corresponding well tool assembly for operation thereof.

30. The method according to claim 29, wherein the interconnecting step further comprises each control module permitting fluid communication between the first flowpath and the second flowpath when the corresponding member is in the first position, and each control module preventing fluid communication between the first flowpath and the second flowpath when the corresponding member is in the second position.

31. The method according to claim 29, wherein the displacing step further comprises displacing at least one of the members to the second position, thereby isolating the corresponding second flowpath.

32. The method according to claim 26, wherein the displacing step further comprises alternately applying pressure to two of the first flowpaths, thereby incrementally displacing each of the members.

33. The method according to claim 26, wherein each of the control modules further includes a ratchet mechanism, and wherein the displacing step further comprises operating the ratchet mechanisms to displace the members between the first and second positions.

34. The method according to claim 26, wherein in the interconnecting step two of the first flowpaths are connected to each of the control modules, one of the first flowpaths being continually in fluid communication with each of the well tool assemblies for operation thereof, and another of the first flowpaths being in fluid communication with each of the well tool assemblies only when a corresponding one of the members is in the first position.

35. The method according to claim 26, wherein at least one of the well tool assemblies is a valve, and further comprising the steps of closing the valve in response to pressure on one of the first flowpaths when a corresponding one of the members is in the first position, and opening the valve in response to pressure on another of the first flowpaths when the corresponding member is in the first position.

36. The method according to claim 26, wherein at least one of the well tool assemblies is a variable choke, and further comprising the step of varying a flow area of the choke in response to pressure on at least one of the first flowpaths when a corresponding one of the members is in the first position.

37. The method according to claim 36, wherein the varying step further comprises operating a ratchet mechanism of the choke to vary the flow area in response to repeated pressure applications on the at least one first flowpath.

38. The method according to claim 26, further comprising the step of preventing displacement of the members by applying pressure to one of the first flowpaths other than the at least one first flowpath used to displace the members, thereby causing each of the members to cease its displacement in response to pressure on the at least one first flowpath when the member has reached a predetermined position.

39. The method according to claim 26, wherein each member further has a third position in which a first predetermined minimum pressure must be applied in the displacing step to displace the member.

40. The method according to claim 39, wherein the displacing step further comprises applying a second predetermined pressure less than the first predetermined pressure on the at least one first flowpath to displace each of the members when the member is in the second position.

41. The method according to claim 40, further comprising the step of operating one of the well tool assemblies by applying a third predetermined pressure less than the second predetermined pressure on the first flowpath when the corresponding member is in the first position.

42. The method according to claim 26, wherein the interconnecting step further comprises connecting the control modules to multiple second flowpaths, each of the control modules being connected to one of the second flowpaths, and each of the members having a third position in which the first flowpath is in fluid communication with a corresponding one of the second flowpaths.

43. The method according to claim 42, wherein the displacing step further comprises simultaneously displacing all of the members to the third position.

44. The method according to claim 42, further comprising the step of simultaneously setting multiple packers connected to the second flowpaths.

45. The method according to claim 26, wherein the interconnecting step further comprises connecting a second flowpath to at least one of the control modules, a corresponding one of the members having a third position in which a third flowpath connected to the at least one of the control modules and extending to a remote location is in fluid communication with the second flowpath.

46. The method according to claim 45, wherein the second flowpath is in fluid communication with an interior flow passage of a tubular string, wherein the displacing step further comprises displacing the corresponding member to the third position, and further comprising the step of monitoring pressure in the flow passage from the remote location via the third flowpath.

47. The method according to claim 45, wherein the second flowpath is in fluid communication with an annulus formed between a tubular string and a wellbore, wherein the displacing step further comprises displacing the corresponding member to the third position, and further comprising the step of monitoring pressure in the annulus from the remote location via the third flowpath.

* * * * *